US012245649B2

(12) United States Patent
Heppard

(10) Patent No.: US 12,245,649 B2
(45) Date of Patent: Mar. 11, 2025

(54) PATIENT GOWN

(71) Applicant: Martha Christine Heppard, U.S.A.F. Academy, CO (US)

(72) Inventor: Martha Christine Heppard, U.S.A.F. Academy, CO (US)

( * ) Notice: Subject to any disclaimer, the term of this patent is extended or adjusted under 35 U.S.C. 154(b) by 0 days.

(21) Appl. No.: 17/720,120

(22) Filed: Apr. 13, 2022

(65) Prior Publication Data

US 2022/0330631 A1 Oct. 20, 2022

Related U.S. Application Data

(60) Provisional application No. 63/175,942, filed on Apr. 16, 2021.

(51) Int. Cl.
*A41D 13/12* (2006.01)
*A41D 27/20* (2006.01)

(52) U.S. Cl.
CPC ..... *A41D 13/1236* (2013.01); *A41D 27/205* (2013.01)

(58) Field of Classification Search
CPC ..... A41D 13/12; A41D 13/1236; A41D 13/1254; A41D 13/1245; A41D 13/1263; A41D 13/129; A41D 27/205; A41D 1/215; A41D 1/22
See application file for complete search history.

(56) References Cited

U.S. PATENT DOCUMENTS 1,037,270 A * 9/1912 Lefkowitz ..... A41D 1/22 2/74
2,109,867 A * 3/1938 Pedlar ..... A41D 1/22 2/73
2,208,906 A * 7/1940 Name not available ..... A41D 10/00 D2/757
2,556,931 A * 6/1951 Miller ..... A41D 13/1236 2/114
3,154,789 A * 11/1964 Lewis, Jr. ..... A41D 13/1245 2/92
3,339,209 A * 9/1967 Larson ..... A41D 13/1236 128/846

(Continued)

OTHER PUBLICATIONS

Twitter post entitled "Dutch Gown", 1 page, posted Apr. 16, 2020, by user Belle (Martha) Heppard, M.D. @ArtistAngle1, retrieved from Internet: https://twitter.com/ArtistAngle1/status/1250676548291776512?cxt=HHwWgMC-3bfspdsiAAAA.

*Primary Examiner* — Heather Mangine
(74) *Attorney, Agent, or Firm* — Fogg & Powers LLC

(57) ABSTRACT

In one embodiment, a patient gown comprises a first portion that includes a first fastening region extending from the top to the bottom. The first fastening region includes fastening device(s) configured to connect the right side of the front with the left side of the front. The back of the first portion includes a second fastening region extending from a top to a bottom. The second fastening region includes fastening device(s) configured to connect the right side of the back with the left side of the back. The patient gown further comprises a second portion configured to engage with the first portion. The back of the second portion includes a third fastening region in alignment with the second fastening region of the back of the first portion. The third fastening region includes fastening device(s) configured to couple the right side of the back with the left side of the back.

8 Claims, 13 Drawing Sheets

(56) References Cited

U.S. PATENT DOCUMENTS 4,458,365 A * 7/1984 Wood ..... A41D 1/215 2/104
4,547,907 A * 10/1985 Netsky ..... A41D 13/129 2/114
4,622,699 A * 11/1986 Spriggs ..... A41D 13/1236 2/114
4,653,120 A * 3/1987 Leaf ..... A41D 13/1236 2/114
4,920,578 A * 5/1990 Janzen ..... A41D 13/129 2/114
5,062,159 A * 11/1991 Jakub ..... A41D 13/1236 2/70
5,084,914 A * 2/1992 Hesch ..... A41D 13/1263 2/227
5,088,117 A * 2/1992 Fulmer ..... A41D 13/1236 2/221
5,133,086 A * 7/1992 Truitt ..... A41D 13/1236 2/105
5,228,141 A * 7/1993 Remsky ..... A41D 13/1236 2/114
5,274,852 A * 1/1994 Hogan ..... A41D 13/1236 2/88
5,440,763 A * 8/1995 Shah ..... A41D 13/1236 2/912
5,572,742 A * 11/1996 McFadden ..... A41D 13/1236 2/70
5,768,707 A * 6/1998 Lederer ..... A41D 13/1236 2/105
5,799,330 A * 9/1998 O'Donoghue-Kitt ..... A41D 13/1236 2/908
5,991,923 A * 11/1999 Maria ..... A41D 13/1236 2/114
6,260,200 B1 * 7/2001 Alfred ..... A41D 13/1263 2/69
6,327,712 B1 * 12/2001 Armstrong ..... A41D 1/215 2/104
6,477,710 B1 * 11/2002 Ojoyeyi ..... A41D 13/1236 2/254
D563,627 S * 3/2008 Warren ..... D2/720
2001/0044948 A1 * 11/2001 Tolson ..... A41D 13/1236 2/114
2002/0162154 A1 * 11/2002 Shamam ..... A41D 13/1245 2/69
2005/0223468 A1 * 10/2005 Hatton ..... A41D 13/129 2/114
2006/0031976 A1 * 2/2006 Nwawka ..... A41D 13/1245 2/114
2007/0245450 A1 * 10/2007 Feodoroff ..... A41D 13/1254 2/114
2007/0271672 A1 * 11/2007 Lentini ..... A41D 13/1245 2/69
2010/0313330 A1 * 12/2010 Sampson-Howlett ..... A41D 13/1245 2/243.1
2011/0219511 A1 * 9/2011 Fishbein ..... A41D 13/1245 2/113
2012/0060257 A1 * 3/2012 Herzog ..... A41D 13/1236 2/114
2012/0159693 A1 * 6/2012 Takahashi ..... A41D 1/22 2/74
2013/0036526 A1 * 2/2013 Rashman ..... A41D 13/1245 2/114
2013/0104281 A1 * 5/2013 Mattick ..... A41D 13/1236 2/114
2013/0133125 A1 * 5/2013 Mungaray ..... A41D 13/1245 2/114
2013/0276202 A1 * 10/2013 Forbes ..... A41D 13/1236 2/114
2014/0031775 A1 * 1/2014 Criss ..... A61F 5/4408 604/355
2015/0150317 A1 * 6/2015 Terrell ..... A41D 13/1245 2/114
2015/0313297 A1 * 11/2015 Ward ..... A41D 13/129 2/114
2018/0064187 A1 * 3/2018 Baker ..... A41D 13/1236
2019/0313703 A1 * 10/2019 Sun ..... A41D 1/06
2022/0104565 A1 * 4/2022 Winthrop ..... A41D 13/1245
2022/0287390 A1 * 9/2022 Revankar ..... A41D 1/22
2022/0330631 A1 * 10/2022 Heppard ..... A41D 13/1236
2022/0378122 A1 * 12/2022 Crystal ..... A41D 1/21
2023/0240392 A1 * 8/2023 Lucas ..... A41D 13/1254 2/69

* cited by examiner

PATIENT GOWN

CROSS REFERENCE TO RELATED APPLICATIONS

This application claims benefit of U.S. Provisional Patent Application No. 63/175,942 filed on Apr. 16, 2021, and titled "PATIENT GOWN", the contents of which are hereby incorporated by reference.

TECHNICAL FIELD

The present disclosure relates to women's examination gowns. More generally, this disclosure relates to gowns worn by medical patients in hospitals, clinics, and doctor offices.

BACKGROUND

In order to enhance efficiency while providing a small degree of comfort and dignity for the patient during a medical examination, patients are often asked to dress in a patient or hospital gown provided by the examiner. Typically, hospital or patient gowns are closed in the front and include an opening along the length of the back of the gown that is held closed by several ties. Such a gown configuration is useful from the perspective of the examiner because it allows access to many areas of the patient's body. However, from the patient's point of view, such a configuration is not optimal. Because the back of the gown includes an opening or slit along the length of the gown back, the back side of the patient is often exposed thereby causing the patient discomfort and embarrassment. Also, these types of gowns are unattractive.

Many different patient gowns have been designed in an attempt to improve upon the basic patient gown design. These alternate designs may succeed in overcoming some of the shortcomings of the basic patient gown, but they too have shortcomings.

Because the designers of patient gowns are typically concerned with creating a gown that helps the medical examiner complete the examination in an expeditious manner, little consideration is given to the appearance or fit of the gown design. Therefore, most patient gowns are not flattering to the wearer thereby causing the wearer or patient some embarrassment during use.

Because the designers of patient gowns are typically concerned with providing doctor or examiner access to the body of the patient during an examination, patient gowns are often designed with little consideration to maintaining coverage of the patient's body during an examination. For instance, to examine the breast of a patient wearing a typical hospital gown, the entire front of the gown is lowered to about the waist level of the patient thereby exposing the entire upper torso of the patient. This is required even if the examination is only of the left or right side of the upper torso. As a result, many patients are either cold, embarrassed, or unnecessarily uncomfortable during such an examination.

SUMMARY

It is with the shortcomings of the prior design attempts and the current need for new and improved patient gowns that the present disclosure has been developed. The present patient gown allows full access to important areas of the patient's body during an examination while at the same time maintaining a high level of coverage and comfort to the patient. In addition, the present patient gown is particularly useful in breast examination procedures, for larger and pregnant patients, and for breast feeding mothers.

In one embodiment, the patient gown of the present disclosure includes a blouse portion for covering the upper torso of the patient and a skirt portion for covering the lower body of the patient.

The blouse portion includes a body with two sleeves extending therefrom. The body includes a front, a back, a top, a bottom, a right side, and a left side. The front includes a center vertical slit from about the top to the bottom. The front vertical slit defines right and left front upper torso panes. The back includes a center vertical slit from about the top to about the bottom. The back vertical slit defines overlapping right and left back upper torso panels. The right and left back upper torso panels are joined at the top of the body and the top includes a had opening.

The skirt portion includes at least one substantially rectangular panel. The panel includes a top and a bottom. At least a portion of the skirt portion top is joined with at least a portion of the back upper torso panels adjacent the bottom of the body to define a waistline. The skirt panel includes a vertical slit in alignment with the blouse back vertical slit.

In another embodiment, the patient gown of the present disclosure includes coupling and/or fastening devices configured to releasably connect the right front upper torso panel with the left front upper torso panel for closing the front vertical slit. In an embodiment, the front vertical slit is oriented approximately diagonal on the bodice and includes coupling and/or fastening devices such as VELCRO or snaps of at least 0.75 inches.

In yet another embodiment, the patient gown of the present disclosure includes coupling and/or fastening devices configured to releasably connect at least a portion of the bottom left back upper torso panel with the bottom right back upper torso panel. In an embodiment, the coupling and/or fastening devices define a lower back closure adjacent the waistline.

In still another embodiment, the patient gown of the present disclosure includes coupling and/or fastening devices configured to releasably connect a portion of both the bottom of the right and left upper torso panels with a portion of the blouse body top on the right or left upper torso panel, respectively. In an embodiment, the coupling and/or fastening devices define right and left panel holders. In some embodiments, the coupling and/or fastening devices include at least one male device such as a snap located on a lower corner of the left or right bodice flaps that are configured to attach to a corresponding female device located on a portion of the shoulder of the bodice. In doing so, a medical provider may secure a selective portion of the bodice required for examination through the coupling of the male and female devices without having to manually hold the bodice flaps during examination.

In still another embodiment, the patient gown may actually be a two-piece set including a blouse portion and a skirt portion. Such an embodiment allows a patient to wear either portion of the set separately or in combination. For example, a patient who only needs an examination of the upper torso portions of their body may be able to wear their own clothing on the lower half of their body thereby further increasing the patient's comfort level.

In one embodiment, a patient gown comprises a first portion configured to cover at least a portion of an upper torso of a patient. The first portion comprises a body with two sleeves extending therefrom, wherein the body includes a front and a back. The front of the first portion includes a first fastening region extending from the top to the bottom of the front of the first portion. A right side of the front of the first portion comprises one side of the first fastening region, and a left side of the front of the first portion comprises another side of the first fastening region. The first fastening region includes at least one first fastening device configured to connect the right side of the front of the first portion with the left side of the front of the first portion. The at least one first fastening device is configured to at least partially close the first fastening region. The back of the first portion includes a second fastening region extending from a top of the first portion to a bottom of the first portion. A right side of the back of the first portion comprises one side of the second fastening region. A left side of the back of the first portion comprises another side of the second fastening region. The second fastening region includes at least one second fastening device configured to connect the right side of the back of the first portion with the left side of the back of the first portion. The at least one second fastening device is configured to at least partially close the second fastening region. The patient gown further comprises a second portion configured to cover at least a portion of a lower body of the patient. The lower portion comprises a front and a back. A top of the second portion is configured to engage with the bottom of the first portion to form a waistline, and the back of the second portion includes a third fastening region in alignment with the second fastening region of the back of the first portion. A right side of the back of the second portion comprises one side of the third fastening region, and a left side of the back of the second portion comprises another side of the third fastening region. The third fastening region includes at least one third fastening device configured to couple the right side of the back of the second portion with the left side of the back of the second portion. The at least one third fastening device is configured to at least partially close the third fastening region.

Other aspects, features and details of the present disclosure can be more completely understood by reference to the following detailed description of a preferred embodiment, taken in conjunction with the drawings and from the appended claims.

BRIEF DESCRIPTION OF THE DRAWINGS

Understanding that the drawings depict only exemplary embodiments and are not therefore to be considered limiting in scope, the exemplary embodiments will be described with additional specificity and detail using the accompanying drawings, as briefly described below.

[1]

DETAILED DESCRIPTION

Figure 1:
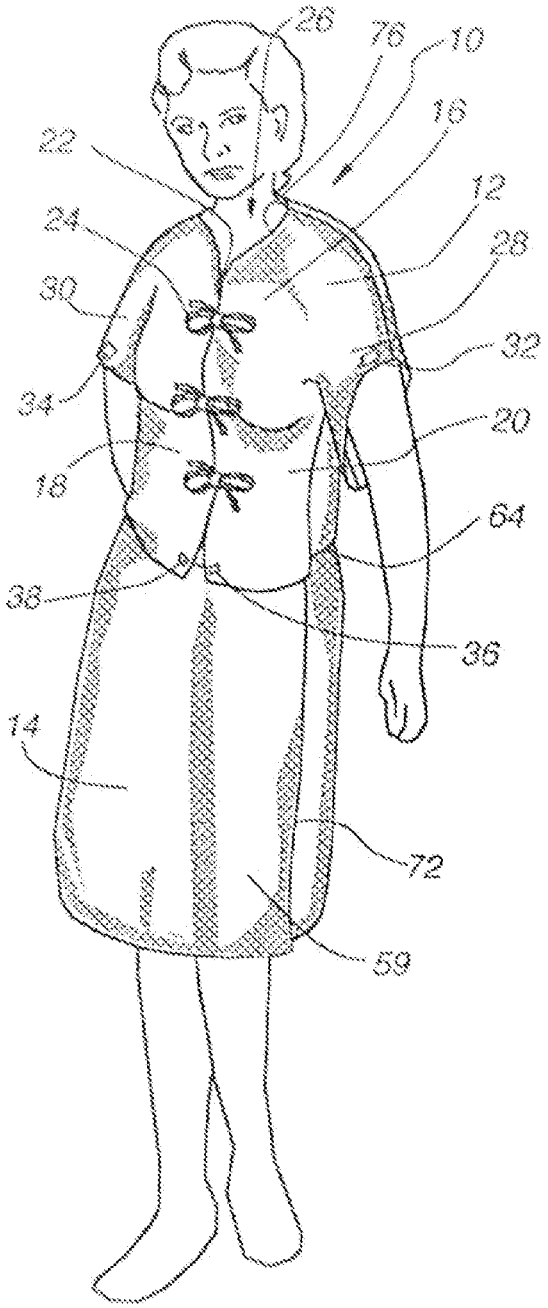
FIG. 1 illustrates a front perspective view of a patient wearing one embodiment of the present patient gown.

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, any methods presented in the drawing figures and the specification is not to be construed as limiting the order in which the individual steps may be performed. The following detailed description is, therefore, not to be taken in a limiting sense.

Due to shortcomings in existing patient gowns, there is a need for a patient gown that both allows for a convenient and expeditious examination of a patient but at the same time enhances the comfort of a patient. There is a need for a patient gown that enhances the comfort of a patient by increasing their self-image while they wear the gown. There is a need for a patient gown that provides a more tailored and more stylish fit to a patient. There is a need for a patient gown that allows for the access and exposure of select areas of a patient's body while at the same time maintaining coverage of the portions of the patient's body that do not require examination.

Patients, especially women, may have experienced sexual trauma and many with this history are reluctant to see medical providers because of current gown issues. Being able to close one's own gown and not need to reveal their entire body when only a small area needs to be examined diminishes having to relive their trauma. Also, some women only have the function of one hand or arm; these women are able to close their gowns on their own with a front entry and large coupling and/or fastening devices. Additionally, women suffer more from arthritis than men, and they too need a gown which they can feel secure and able to close on their own, with front coupling and/or fastening devices. Thus, improving a patient's sense of dignity by allowing them control over their gown improves patient-doctor communication and care.

The present patient gown is designed to provide full access to important areas of the patient during an examination while at the same time preserving the comfort and dignity of the patient. In addition, the present patient gown is designed to fit patients of varying sizes and to provide a more tailored fit to patients. One embodiment of the present invention patient gown includes a combination blouse and skirt. To put the patient gown on, the patient simply unties and opens the front of the blouse portion and opens the front of the skirt portion. Next, the user puts either arm through either of the sleeves in the blouse portion and pulls both sides of the front of the blouse together thereby closing the blouse portion. The user then adjusts the skirt portion by wrapping the skirt around the lower portion of their body until the waist of the skirt is extended to a comfortable fit and then secures the skirt portion. The user then secures the left and right front portions of the blouse to one another using ties that are attached to both portions of the blouse near the centerline of the blouse.

FIGS. 1-22 provide detailed drawings of embodiments of the present patient gown. FIGS. 1-5 show one embodiment of the present patient gown of a particular size as worn by patients within the size range. FIGS. 6-9 illustrate one embodiment of the present patient gown showing various front views of the gown. FIGS. 10-11 illustrate various views of the back of the present patient gown. FIG. 12 illustrates one embodiment of the present patient gown with the skirt portion in an open position. FIGS. 13-16 show the various fabric panels that are joined together to manufacture one embodiment of the present patient gown. FIGS. 17-22 depict additional embodiments of the present patient gown.

Figure 2:
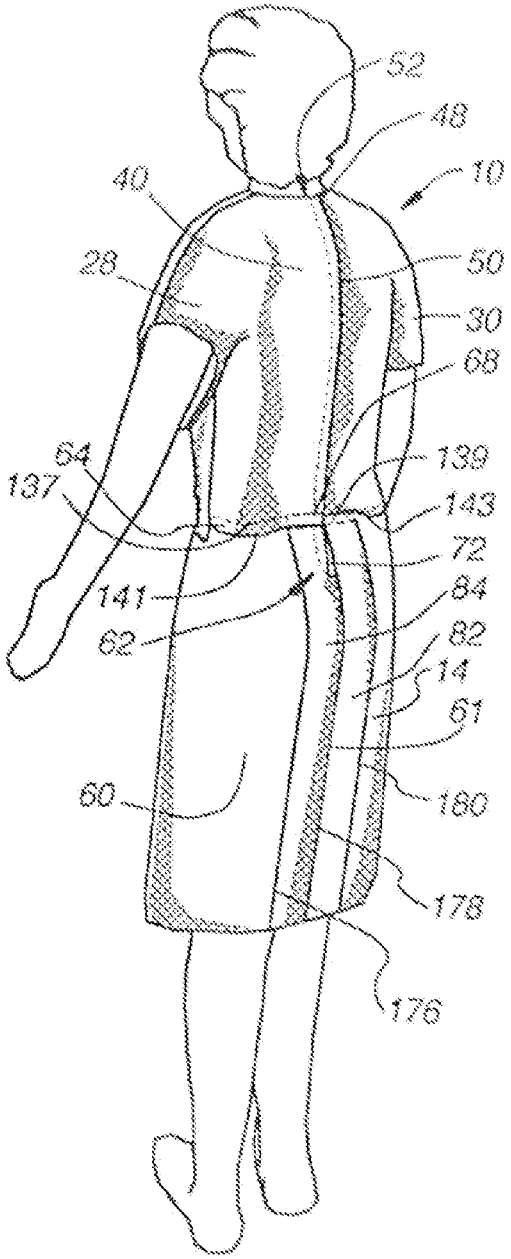
FIG. 2 illustrates a rear perspective view of a patient wearing one embodiment of the present patient gown.

As illustrated in FIGS. 1-2, one embodiment of the present patient gown 10 includes a blouse portion 12 that covers the upper torso of the patient from about the patient's neck to the patient's waistline and a skirt portion 14 that covers the lower body of the patient from about the patient's waistline to the patient's knees. The front 16 of the blouse portion 12 includes two panels, a right upper torso panel 18 and a left upper torso panel 20. The front panels 18 and 20 normally abut when in a closed position along a pleat 22 that runs down the center of the front of the blouse portion 12. In the embodiment illustrated in FIG. 1, ties 24 are attached to both the left and right panels 20, 18 adjacent the center pleat. The ties 24 are used to both draw and secure the right and left panels 18, 20 to one another in a manner that is convenient for the patient, accommodates a range of breast sizes while providing comfort and dignity, and provides an attractive appearance. Although ties are preferred in the FIG. 1 embodiment, other coupling and/or fastening devices configured to secure the left and right panels to one another could be used. The top 26 of the patient gown 10 (and top of the blouse portion 12) includes an opening from which the neck and head of the patient extends. The blouse portion 12 also includes left and right sleeves 28, 30. In the embodiment illustrated in FIG. 1, the sleeves 28, 30 are depicted as extending from about the top 26 and along the patient's shoulders to a point midway between the patient's shoulder and patient's elbow. In other embodiments, the length of the sleeves 28, 30 can vary from no sleeve at all to a full sleeve extending from the top of the patient's shoulder to about the patient's wrist. As is inherent in the fit of a blouse, the blouse portion 12 of the embodiment illustrated in FIG. 1 is designed to fit a patient in a loosely and conformal way. This can be seen from the way the left sleeve 28 fits the patient in FIG. 1.

The embodiment of the patient gown illustrated in FIG. 1 includes a skirt portion 14 that is a wrap-around type skirt. As is known in the art, a wrap-around skirt is basically a substantially rectangular piece of fabric that wraps around the lower portion of a wearer's body and wraps over itself. The skirt may be tapered at the hem if desired to obtain a tailored appearance. A wrap-around type skirt allows for convenient access to the patient's lower body for examination purposes. Although not illustrated in FIG. 1, the skirt portion 14 also includes suitable means (described in greater detail below) for securing the top layer of the skirt to the bottom layer of the skirt at the desired fit.

Figure 5:
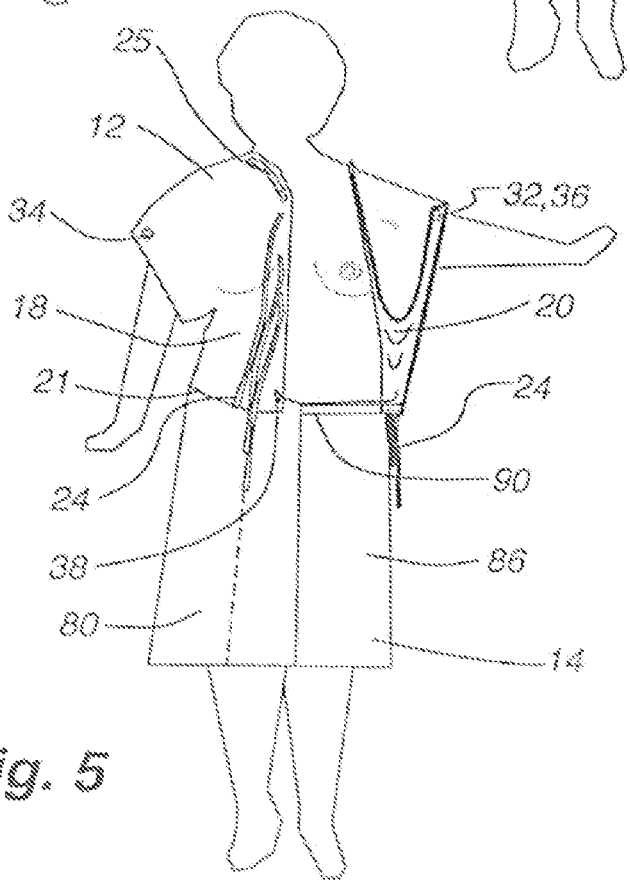
FIG. 5 illustrates a larger patient wearing one embodiment of the present patient gown with the left bodice in an open position.

The front 16 of the blouse portion 12 also includes panel holders. Two fastening tabs 32, 34 are located at or about the top end part of each sleeve portion and two other fastening tabs 36, 38 are located at or about the bottom of each of the front blouse panels 18, 20 adjacent the center vertical pleat 22 along the front of the blouse. The tab fasteners 36, 38 on each respective panel cooperate to define left and right panel holders. As illustrated in FIG. 5 and below, both the left and right front upper torso panels 18, 20 (also referred to as the right and left bodices) can be held in an open position by placing the lower fastening tab adjacent the bottom of each right and left bodices in contact with the upper fastening tab adjacent the end of each sleeve. The panel holders allow an examination of the patient to take place without requiring either the examiner or the patient to hold the bodices in an open position. In the case of a breast exam, for example, the patient may hold her arm near the breast being examined at a prescribed position to facilitate the examination, rather than at a position for holding the panel, which might interfere with the examination.

As mentioned earlier, the embodiment illustrated in FIG. 1 also includes blouse ties 24 for securing the right and left bodices 18, 20 to one another thereby closing the center vertical pleat 22 in the front 16 of the blouse 12. As better illustrated in FIGS. 5-6, the ties 24 are typically secured to the surface of each bodice at a certain distance spaced horizontally from the center vertical edges of the bodices 18 and 20. By spacing the ties 24 horizontally away from the center vertical edges of the bodices 18 and 20 of the blouse, the blouse portion 12 is able to fit patients of varying chest sizes while maintaining the pleat 22. Alternatively, the ties on one of the bodices 18, 20 may be positioned near the vertical edge while the ties on the other bodices 20, 19 are horizontally spaced away from the vertical edge, to provide an overlap rather than a pleat.

In addition, the coupling and/or fastening devices provided with the skirt portion 14 are typically adjustable. For example, in one embodiment, a strip of hook and loop fastening material may be run along the waistline of the lower layer of the skirt portion and a matching strip of hook and loop material may be run along the inside of the top layer of the skirt portion. Such a configuration will allow the waistline of the skirt portion to be adjusted in accordance with the waistline of the patient. Additional description of the skirt portion 14 coupling and/or fastening devices is provided in FIG. 12 and corresponding text below.

FIG. 2 illustrates the back of the patient gown illustrated in FIG. 1. The back 40 of the blouse portion 12 also includes a right 42 and left 44 upper torso portion (also referred to as right and left back panels). The right and left back panels 42, 44 are united adjacent the top 46 of the back 40 of the blouse portion 12 or at the back 48 of the neckline 76 of the neck and head opening. In one embodiment, the right and left back upper torso panels 42, 44 overlap one another forming a back overlap seam 50. Beneath the back overlap seam 50 is a center vertical slit 52 that runs from the top 26 of the blouse back to the waistline 64 of the blouse back.

Because the back upper torso panels 42, 44 are preferably united near the top along the neckline 76, it is possible for an examiner to separate the back panels along the center vertical slit 52 in the back of the blouse to access the patient during an examination. As illustrated in FIGS. 2 and 11, the back 60 of the skirt portion 14 along the center 61 of the skirt portion also includes a vertical slit 62 extending from the top 64 of the skirt portion 14 or waistline of the patient gown to approximately three to five inches downward. The vertical slit 62 in the back of the skirt is designed so that it is in alignment with the vertical slit 52 in the back of the blouse, thereby forming a continuous vertical slit 63 from the back neckline closure 48 of the blouse to the end of the vertical slit 62 in the back of the skirt. As described further below, the blouse portion 12 and skirt portion 14 are fastened to one another along the back waistline 64 of the patient gown on the bottom 66 of the right and left back upper torso panels, thereby maintaining the overlap 50 and drawing the waistline 64 snug to maintain the comfort and dignity of the patient when an examination of the back is not being performed.

A lower back closure 68 is provided adjacent the waistline 64 of the patient gown along the center vertical slit 63 under the overlap 50 in the back of the patient gown. In one embodiment, hook-and-loop fastener tabs are attached to the surface of the patient gown. The lower back closure is provided to ensure that the vertical slit extending down the center of the back of the patient gown remains closed when the patient is not being examined, while being easily undone during an examination to provide examiner access. As illustrated in FIG. 11 and discussed further below, when the lower back closure is opened, extensive access is provided to the back of the patient for examination.

Figure 3:
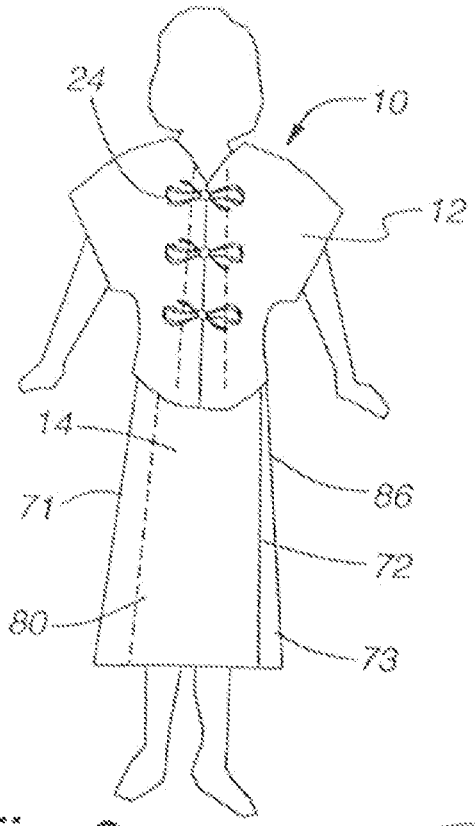
FIG. 3 illustrates a smaller patient wearing one embodiment of the present patient gown.

As mentioned above, both the blouse portion 12 and the skirt portion 14 of the present patient gown can accommodate different sized patients within a considerable range of sizes. In one embodiment, three different sizes of the gown, small, medium, and large, cover a range of sizes from women's size two to women's size twelve and larger. FIG. 3 illustrates a smaller patient wearing a small or medium size embodiment of the present patient gown. When worn by a smaller patient, the blouse ties will be drawn tightly to provide a good fit to the patient. Correspondingly, the skirt portion will be wrapped around the lower body of the smaller patient such that the skirt overlap seam 72 is closer to the left side 71 of the skirt (or right side 73 depending on whether the skirt is configured to wrap in either a clockwise or counter-clockwise direction) thereby providing a smaller diameter of the waistline to better fit the smaller waistline of the smaller patient.

Figure 4:
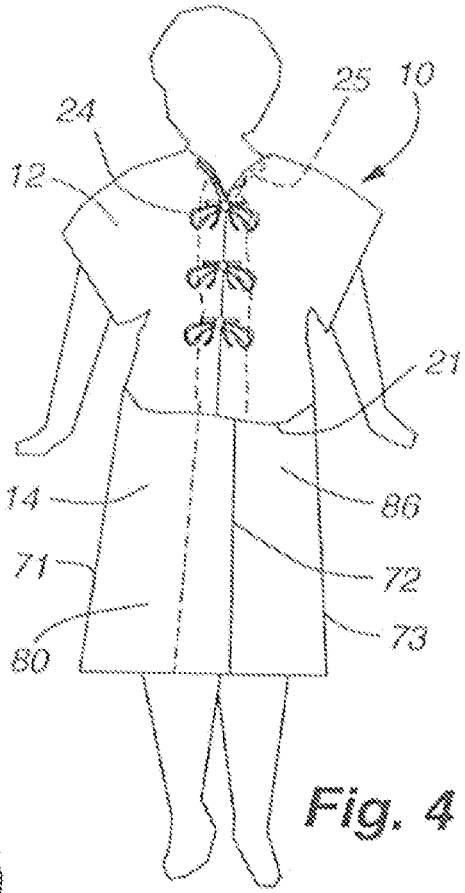
FIG. 4 illustrates a larger patient wearing one embodiment of the present patient gown.

FIG. 4 shows a larger patient wearing a large size embodiment of the present patient gown. In order to provide a good fit to a large patient, the blouse ties will be more loosely tied than when worn by a smaller patient or as illustrated in FIG. 3. As mentioned above, because the ties are attached with the surface of the blouse at a horizontal spacing away from the centerline of the blouse, the blouse portion can be adjusted depending on how tightly or loosely the ties are tied while maintaining the pleat 22. With the large size patient, the range of adjustment is greater than with the other size embodiments. Also in contrast on FIG. 3, the skirt overlap seam 72 on a larger patient will typically be more centrally located with respect to the lower body of the larger patient. Basically, the top portion of the skirt is moved further along the waistline, thereby increasing the diameter of the waistline to correspond to the larger waistline of a larger patient. In addition, the large size embodiment includes fastener 25, such as a hook and loop fastener or other type of fastener, along the neckline. Because the large size embodiment includes a larger range of adjustment, the neckline must sometimes be fastened to ensure a proper fit for the patient. The right and left bodices 18, 20 of the large size embodiment also includes an extended bottom portion 21. The extended bottom portion 21 provides additional coverage for larger patients.

FIG. 5 illustrates one embodiment of the present patient gown 10 with the left bodice 20 in an open position. During an examination, it may be necessary for the examiner to examine all or part of the upper torso of the patient. In FIG. 5, the blouse portion 12 is in an open position to allow an examiner to examine the left upper torso portion of the patient. To open the blouse portion, the blouse ties 24 are untied and left hanging in an untied position. Depending on which panel the examiner desires to open (in some cases both), the particular panel holder tab 36, 38 located in the lower center corner of the front bodice 18, 20 is lifted away from the patient and placed in contact with the panel holder tab 32, 34 located at the top of the blouse near the end of the left sleeve on the same panel. In the embodiment in FIG. 5, the left bodice 20 is held in the open position by the left panel holder 32, 36.

Also, in the embodiment in FIG. 5, the panel holder tabs are fabricated from hook-and-loop fastener material. In one embodiment, the hook-and-loop fastener material used for the tab 32, 34 located at the top of the blouse near the end of the sleeve is composed of the abrasive portion of the hook-and-loop fastener material. In contrast, the panel holder tab 36, 38 located adjacent the lower corner portion of the bodice near the centerline of the blouse is composed of the softer portion of the hook-and-loop fastener material. This is done to ensure that during connection of the left panel holder tabs no abrasive materials are inadvertently pressed against the body of the patient. In fact, in any instances where hook and loop fastener materials are used in the present patient gown, the softer component of the hook and loop fastener material can be configured to be facing inwardly toward the patient during use while the abrasive component of the hook and loop fastener material can be configured to be facing outwardly from the patient during use.

Figure 8:
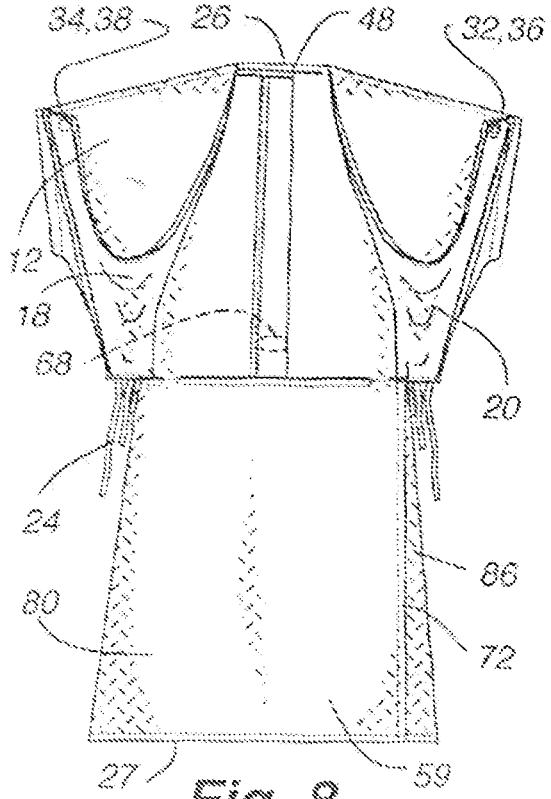
FIG. 8 illustrates one embodiment of the present patient gown with both the right and left bodices in an open position.

Although in FIG. 5 only the left bodice is retained in an open position by the left panel holder, if necessary, the right bodice may also be held in an open position by an identical right panel holder to allow the examiner to examine the entire upper torso of the patient at the same time. FIG. 8 illustrates one embodiment of the present patient gown having both the right and left panels held in an open position by the right and left panel holding tabs. Additional description of FIG. 8 is provided below.

Also shown in FIG. 5 is the fastener of the skirt portion. In the FIG. 5 embodiment and disclosed in greater detail below and in FIG. 12, a strip of hook and loop-type fastener is connected to the waistline portion of the skirt portion on both the bottom layer of the skirt portion and the overlapping top layer of the skirt portion. As mentioned before, the component of the hook and loop material that is facing outwardly from the patient (in this case, the strip on the bottom layer of the skirt portion) is abrasive, and the strip of hook and loop fastener material facing inwardly toward the patient is soft to the touch.

Figure 6:
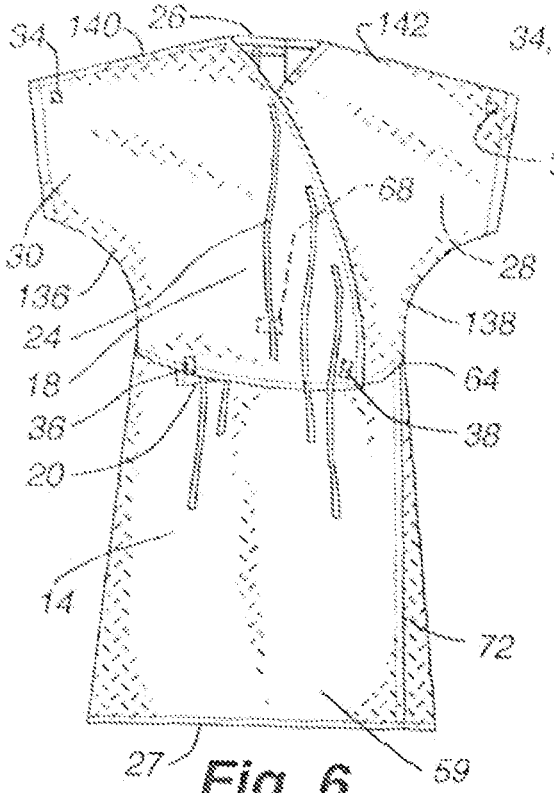
FIG. 6 illustrates a front view of one embodiment of the present patient gown.

FIGS. 6-9 illustrate the front of one embodiment of the present patient gown, as it might appear when laid out on a flat surface. In FIG. 6, the blouse portion 12 of the patient gown 10 is in a closed but untied configuration. The right bodice 18 is overlapping the left bodice 20, and the blouse ties 24 used to connect the right and left bodices are untied and hanging from their respective bodices. As clearly illustrated in FIG. 6, the blouse portion includes panel fastener tabs 32, 34, 36, 38 that are used to hold the bodices in an open position during examination. The fastener tabs are located on each panel at the top 32, 34 of the panel near the end of the respective sleeve and at the bottom 36, 38 of the panel along the waistline 64 of the blouse adjacent the portion of the bodice closest to the center slit. As clearly illustrated in FIG. 6, in a closed position, the top 26 of the blouse 12 includes a head or neck opening 74 defined by a neckline 76.

Figure 7:
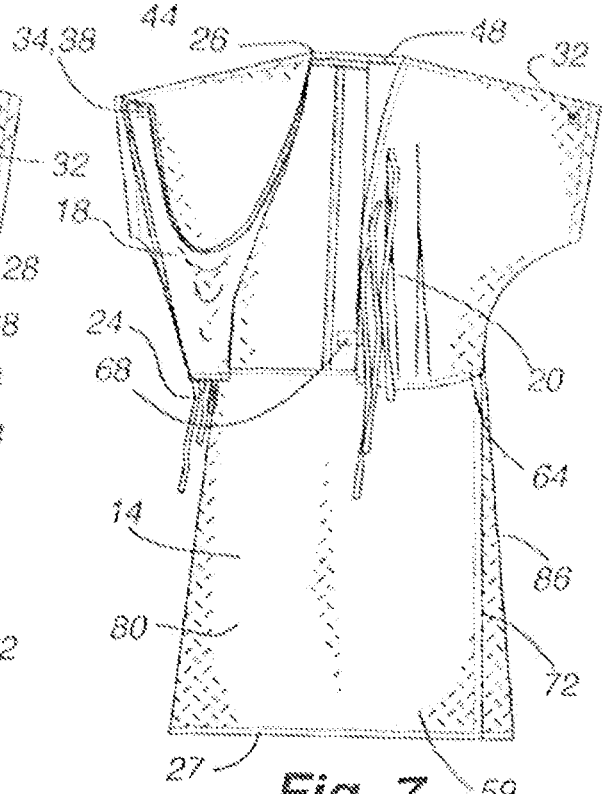
FIG. 7 illustrates one embodiment of the present patient gown with the right bodice in an open position.

In FIG. 7, one embodiment of the present patient gown 10 is illustrated with the right bodice 18 retained in an open position by the right panel holder 34, 38. In contrast, the left bodice 20 remains in a position that continues to provide coverage to the remainder of the patient's upper torso. In both FIGS. 6 and 7, the skirt portion 14 remains in a closed position.

FIG. 8 illustrates one embodiment of the present patient gown 10 with both the right and left bodices 18, 20 held in the open position by the respective panel holders 32, 34, 36, 38. The configuration in FIG. 8 allows the examiner extensive access to the upper torso of the patient during the examination.

Figure 9:
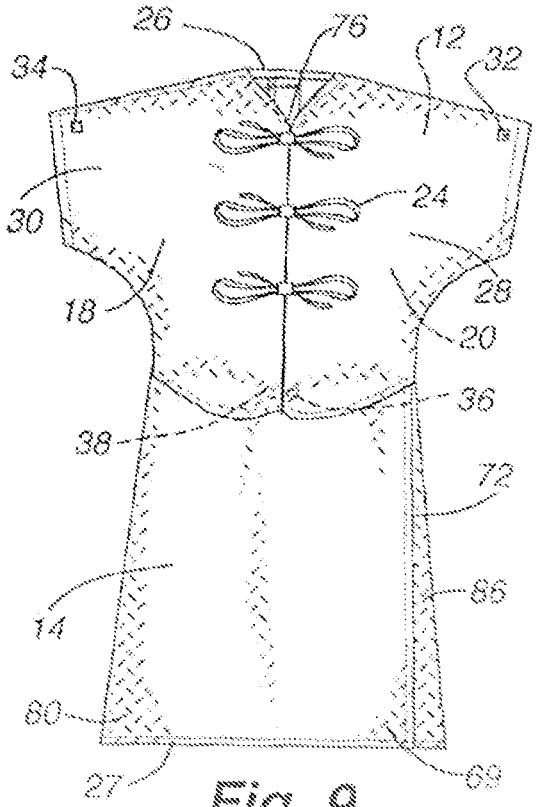
FIG. 9 illustrates a front view of one embodiment of the present patient gown with the right and left bodices in a closed position.

FIG. 9 illustrates one embodiment of the present patient gown 10 in a fully closed configuration. The blouse ties 24 are all tied to draw the right and left bodices 18, 20 together thereby closing the blouse center slit or opening 22. The skirt portion 14 is also in a closed position.

Figure 10A:
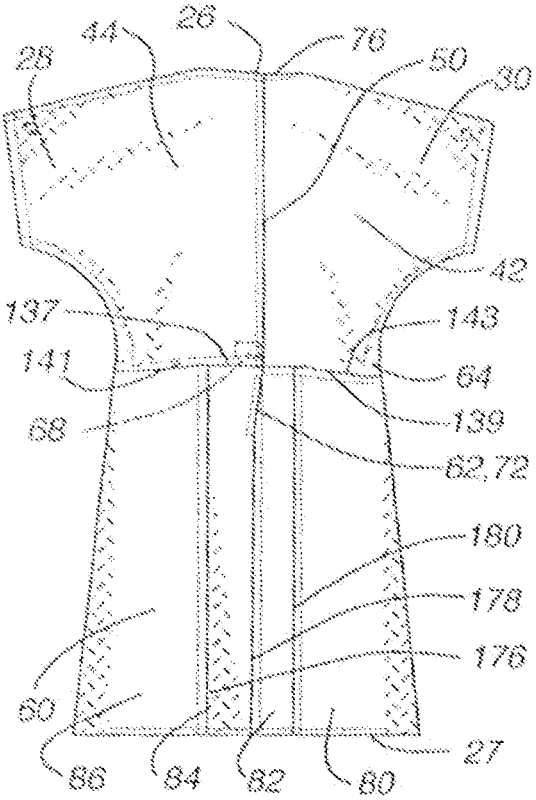
FIG. 10*a* illustrates the back of one embodiment of the present patient gown.
Figure 11:
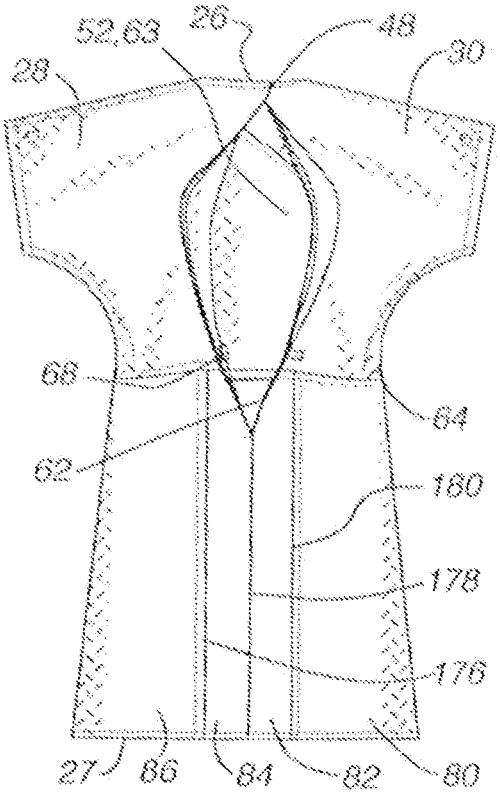
FIG. 11 illustrates the back of one embodiment of the present patient gown with the center back opening in an open position.
Figure 12:
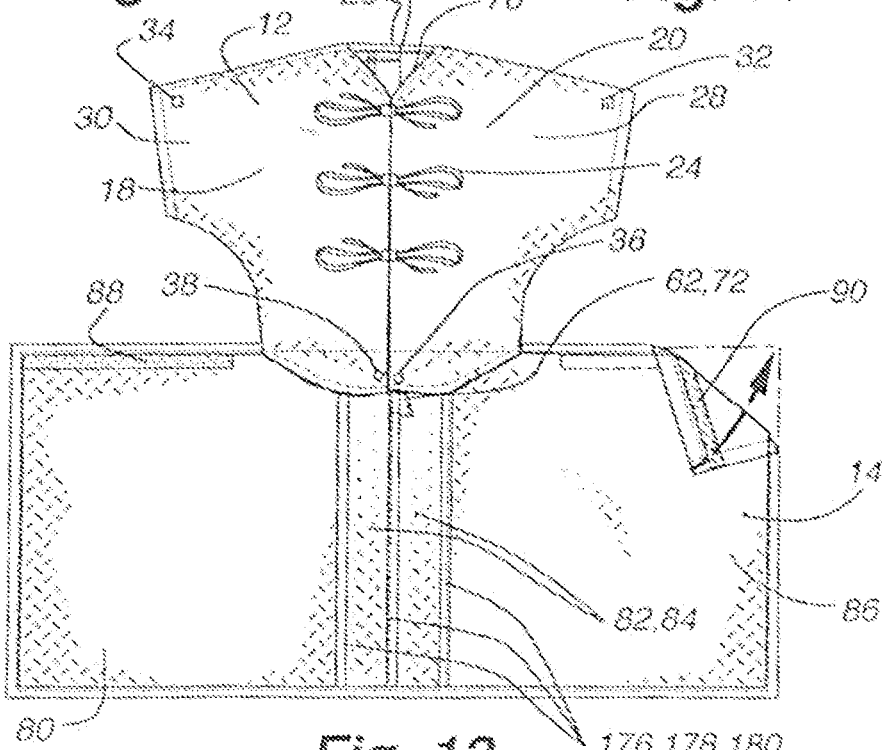
FIG. 12 illustrates a front view of one embodiment of the present patient gown with the skirt portion in an open position and the blouse portion in a closed position.

FIGS. 10*a* and 11 illustrate the back of one embodiment of the present patient gown 10. As illustrated in FIG. 10*a* and described above, the back 40 of the blouse portion 12 includes both a right 42 and a left 44 upper torso panel. The right and left upper torso panels cover the back upper torso of the patient. Although not shown in FIG. 10*a*, the top of the blouse portion includes a neck or head opening 74 defining a neckline 76 as illustrated in FIG. 6. In addition, the left and right upper back torso panels define the back side of the left 28 and right 30 sleeves. As illustrated in FIG. 10*a*, the left and right upper torso panels are configured such that they overlap at the center of the gown back. As mentioned earlier above, the back overlap seam 50 is joined together at the top of the blouse back adjacent the neckline. The remainder of the back overlap seam 50 extending downwardly toward the waistline 64 of the blouse is not joined together and can be separated by an examiner to expose the back of the patient. As mentioned above, the bottom portions of the left and right back upper torso panels are connected with the top portion of the back of the skirt portion along the waistline of the gown. In the embodiment illustrated in FIGS. 10*a* and 11, the bottom portions 118, 130 (see FIG. 14) of the left and right back upper torso panels are only connected with the skirt along a portion of the top edges 146, 148 (see FIG. 15) of the skirt tailoring panels 82, 84 at seams 137, 139. Because the blouse portion is generally fabricated to fit a medium size patient rather loosely, the opening between the blouse portion and skirt portion along the back waistline is typically covered by overhanging portions 141, 143 of the blouse (see FIG. 2). Such a design allows patients additional mobility while wearing the patient gown and allows greater access to the patient during examinations. The skirt portion 14 also includes a vertical slit 62 located in the back center 61 of the skirt portion extending from the waistline 64 downwardly. This slit is also known as the lower back opening 62 and can be of varying length but in some embodiments is about three inches. As illustrated in FIGS. 10*a*-11, the center vertical slit or opening 52 that resides beneath the back overlap beneath the center of the left and right back upper torso panels is in alignment with the lower back slit or opening 62 to form a continuous back opening 63. At the top and adjacent the neckline on the back of the blouse, the back opening 63 is joined together at closure 48 to define the back of the neckline of the blouse. At the bottom end of the back opening, the back opening is joined together by one of the skirt portion tailored seams.

As illustrated in FIG. 11, an examiner can gain substantial access to the back of a patient by pulling the left and right back upper torso panels away from each other to enlarge the back opening. The back opening can include a closure 68 to ensure that it remains closed when the patient is not being examined. In one embodiment, the back closure 68 is located at the waistline 64 of the patient gown or adjacent to the lower back of the patient. When in a closed position, the lower back closure holds both the left and right back upper torso panels in their overlapped position and causes the lower back slit or opening to also overlap thereby causing the entire back opening to remain in a position that fully covers the back of the patient.

Figure 10B:
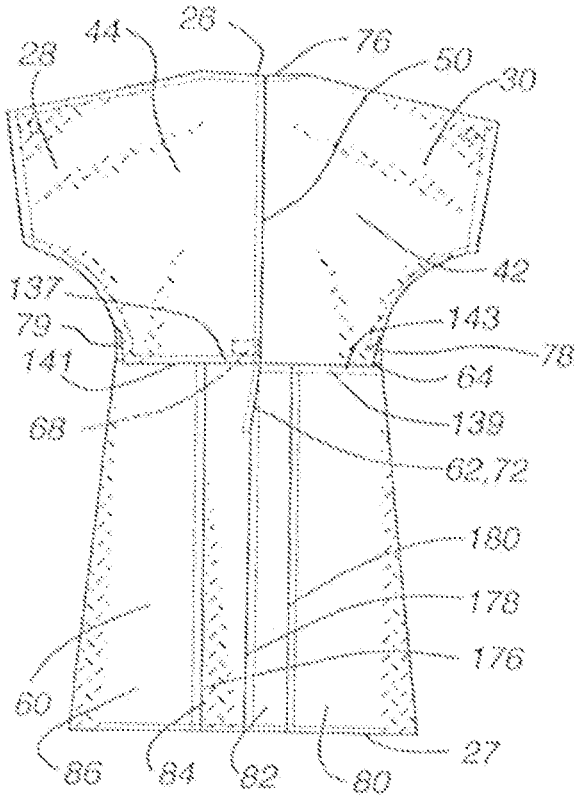
FIG. 10*b* illustrates the back of one embodiment of the present patient gown.

FIG. 10*b* illustrates an alternative embodiment of the blouse portion illustrated in FIG. 10*a*. In some embodiments, the back upper torso panels 42, 44 are joined with the skirt portion all along the waistline 64 and not just to the tailoring panels 82, 84. Some embodiments also include side access slits 78, 79. Along both sides of the patient's body along the seams that connect the right and left bodices 18, 20 with the right and left back upper torso panels 42, 44 are slits 78, 79 extending from about the waistline 64 upwardly. The slits can vary in length but typically are no longer than approximately three inches. The purpose of each slit is to allow the examiner greater access to the side of the patient's torso in the area adjacent the slit.

FIG. 12 illustrates one embodiment of the present patient gown 10 with the blouse portion 12 in a fully closed position and the skirt portion 14 in a fully open position. The embodiment in FIG. 12 shows that the skirt portion includes several different panels 80, 82, 84, 86 stitched together. The two larger panels 80, 86 wrap around the lower body of the patient and overlap each other. In some embodiments, the larger left-most 80 and right-most 86 panels will be joined together by one or more center panels 82, 84. The center panels 82, 84 are generally used to provide the skirt portion with a more tailored fit to the wearer. The overlap panel or left most panel 80 in FIG. 12 includes a strip 88 of fastening material along the waistline 64 at the top of the panel. Strip 88 is actually located on the interior of the skirt portion or the side of the skirt portion that faces the patient and is not exposed to the outside. In contrast, the right-most panel 86 includes a matching strip 90 of fastening material along the top of the panel on the outside of the skirt portion. Thus, to close the skirt portion so that it matches the configuration shown in FIGS. 8-9, the right-most panel is wrapped around the lower body of the wearer toward the front center area of the lower body of the wearer and the left-most panel is wrapped around the wearer toward the centerline of the front of the wearer and over the right-most panel 86. The fastener strips 88, 90 are thus caused to come in contact with one another thereby holding the various panels of the skirt portion together. Note that the skirt may be fabricated such that the right-most panel 86 wraps over the left most panel 80. In such an embodiment, the strips 88, 90 of fastening material would be configured opposite to that above.

In one embodiment, a hook and loop fastening material is used as the skirt waist fastener. As mentioned above, the abrasive component of the hook and loop fastener material is typically placed on the outside of the skirt portion so that it is facing away from the wearer and the soft component of the hook and loop fastener is placed on the inside of the skirt panel so that it is facing toward the wearer. This is done to ensure that no abrasive materials come in contact with the body of the wearer.

FIGS. 13-16 illustrate an exemplary set of fabric panels that are joined together to form one embodiment of the present patient gown. The blouse portion of the patient gown is formed by four fabric panes: 1) a right front upper torso panel 18; 2) a left front upper torso panel 20; 3) a right back upper torso panel 42; and 4) a left back upper torso panel 44.

The right front upper torso panel includes a right top edge 92, a right neckline edge 94, a right inside edge 96, a right bottom edge 97, a right outside edge 98, and a right sleeve edge 100. The left front upper torso panel includes a left top edge 102, a left sleeve edge 104, a left outside edge 106, a left bottom edge 108, a left inside edge 110, and a left neckline edge 112. The edges of the front upper torso panels define the perimeter of each panel.

The left back upper torso panel includes a left top edge 114, a left neckline edge 116, a left inside edge 117, a left bottom edge 118, a left outside edge 120, and a left sleeve edge 122. The right back upper torso panel similarly includes a right top edge 124, a right sleeve edge 126, a right outside edge 128, a right bottom edge 130, a right inside edge 132, and a right neckline edge 134. The edges of the back upper torso panels define the perimeter of each of these panels.

As illustrated in FIGS. 6-7, the blouse portion 12 is generally fabricated by joining the right outside edge 98 of the right front upper torso panel to the right outside edge 128 of the right back upper torso panel to form a right side seam 136, joining the left outside edge 106 of the left front upper torso panel to the left outside edge 120 of the left back upper torso panel to form a left side seam 138, joining the right top edge 92 of the right front upper torso panel to the right top edge 124 of the right back upper torso panel to form a right top seam or right shoulder seam 140, joining the left top edge 102 of the left front upper torso panel to the left top edge 114 of the left back upper torso panel to form a left top seam or left shoulder seam 142, and joining the left and right neckline edges 116, 134 along the left and right inside edges 117, 132 on the back upper torso panels to form the neckline back closure 48.

The result of creating the seams mentioned in the previous paragraph is the formation of a loosely but conformally fitting blouse having right and left sleeves with open free ends, a vest-like blouse front with a center vertical pleat, and a blouse back that includes a closed back neckline with a center vertical slit or opening that extends from the neckline closure to the bottom edges of the back upper torso panes. In one embodiment, the left and right back upper torso panels are overlapped so that the slit running down and between the left and right back upper torso panels is typically covered by the overlapping back upper torso panels.

Figure 15:
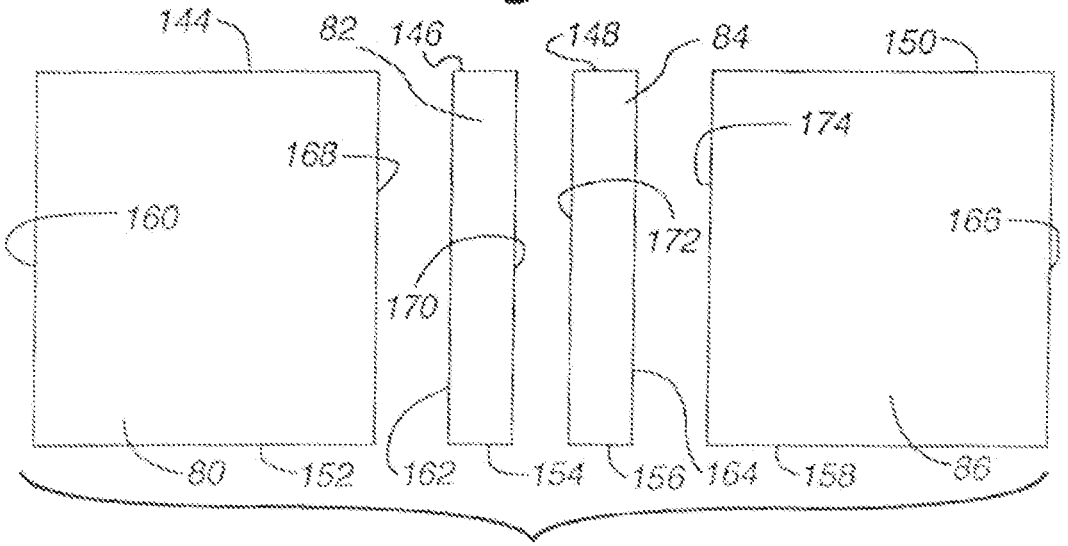
FIG. 15 illustrates the front, back, and tailoring panels of one embodiment of the present patient gown.

As illustrated in FIG. 15 and in FIG. 12, in one embodiment of the present patient gown, the skirt portion is composed of several substantially rectangular panels: a skirt overlap panel or left-most panel 80; a first tailoring panel 82; a second tailoring panel 84; and a skirt bottom or right-most panel 86. All of the skirt panels include a top edge 144, 146, 148, 150, a bottom edge 152, 154, 156, 158, an outside edge 160, 162, 164, 166, and an inside edge 168, 170, 172, 174. The skirt portion is generally fabricated by joining the inside edge 168 of the skirt overlap panel 80 to the first tailoring panel outside edge 162 to form a first tailored seam 176. Next, the inside edge 170 of the first tailored panel 82 is joined to the inside edge 172 of the second tailoring panel 84 to form a second tailored seam 178. The outside edge 164 of the second tailoring panel 84 is then joined to the inside edge 174 of the skirt bottom panel 86 to form a third tailored seam 180. Also, when the skirt tailoring panels are connected with one another, a slit or opening 62, is allowed in the top center of the tailoring panels as described above.

In some embodiments, the tailoring panel seams may be tailored so that the bottom of the skirt 27 is caused to curve toward the patient. This can be achieved by reducing the width of each tailoring panel from the top edges 146, 148 to the bottom edges 154, 156. Such a design may be preferable in that it can prevent the skirt portion from opening thereby providing additional coverage for the patient while they are in a seated position.

In one embodiment of the skirt portion, the skirt portion includes one or more pleats along the waistline and extending downwardly. The pleats are formed by gathering and joining together a portion of the waistline material. Pleats sometimes provide a better fit to the patient.

In other embodiments of the present patient gown, the skirt portion may be fabricated from fewer panels or more panels providing the skirt portion is configured to provide the wearer with a comfortable and tailored fit. To complete the fabrication of the main body of the patient gown, the left and right bottom edges 118, 130 of the left and right back upper torso panels 44, 42 are joined with a portion of the top edges 146, 148 of the skirt tailoring panels 82, 84 to form left and right waistline seams 137, 139 (see FIGS. 2, and 10*a* and 10*b*).

As mentioned above, various coupling and/or fastening devices are connected with the blouse portion and skirt portion to complete the fabrication of the patient gown. In one embodiment, the blouse portion includes ties for connecting the right front upper torso panel with the left front upper torso panel and tabs for holding both front upper torso panels in an open position.

The skirt portion of the patient gown includes coupling and/or fastening devices along the waistline for adhering the front or overlap panel with the skirt back panel. Finally, coupling and/or fastening devices may be provided along the center back opening of the blouse back to ensure the center vertical slit in the blouse back remains in the closed position when the patient is not being examined.

Figure 13:
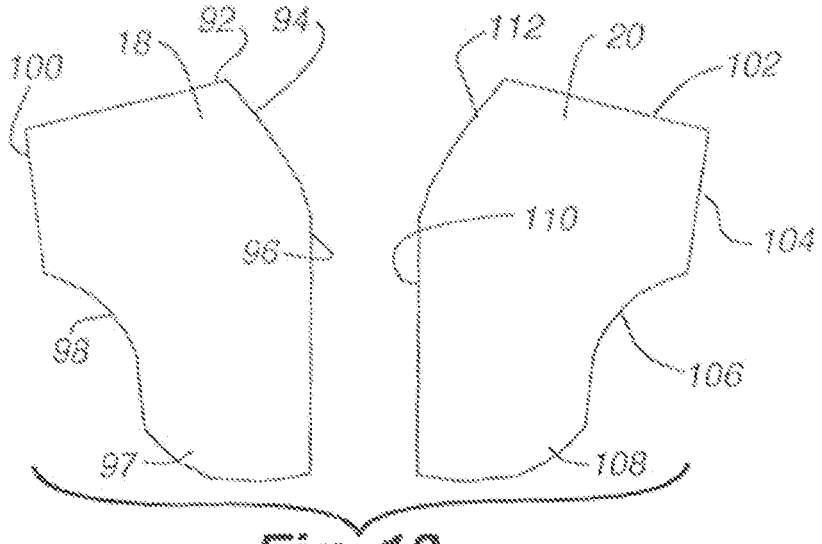
FIG. 13 illustrates the right and left front upper torso panels of one embodiment of the present patient gown.
Figure 14:
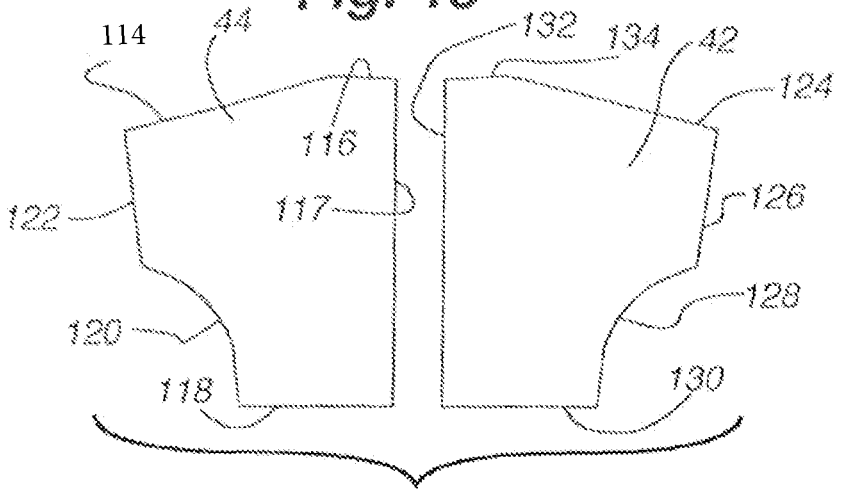
FIG. 14 illustrates the left and right back upper torso panels of one embodiment of the present patient gown.
Figure 16A:
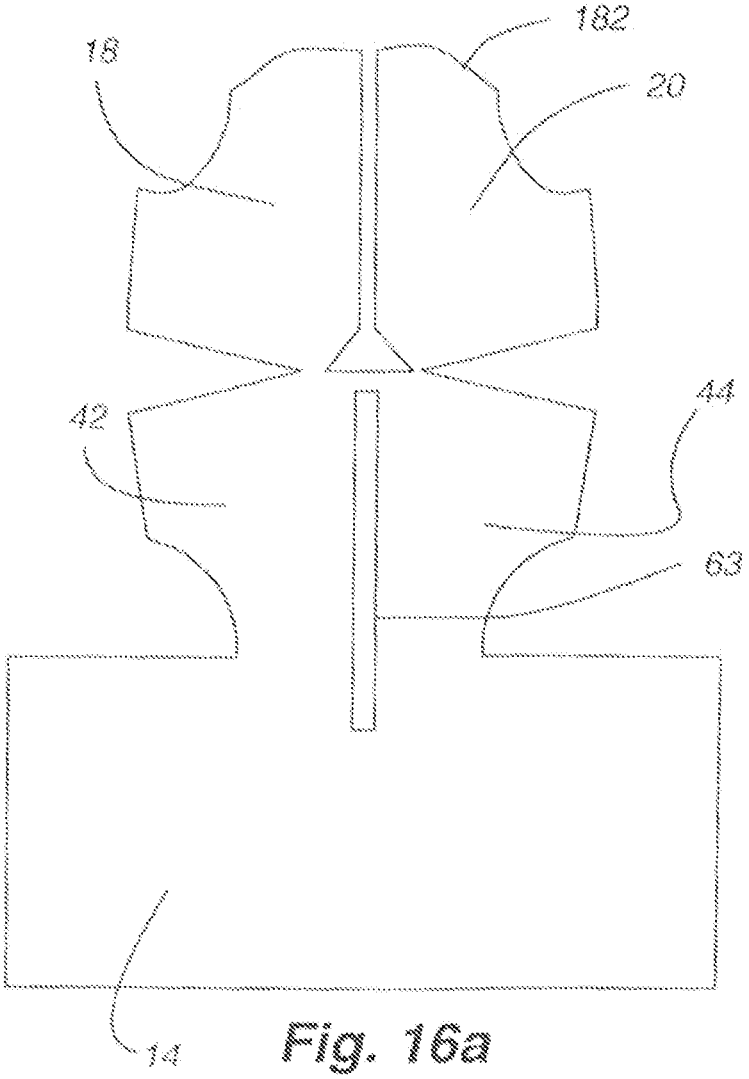
FIGS. 16*a* and 16*b* illustrate two fabric panels that form one embodiment of the present patient gown.
Figure 16B:
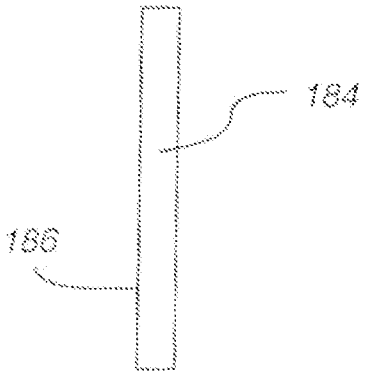

Although FIGS. 13-14 illustrate an embodiment that includes multiple fabric panels, the present patient gown can also be fabricated using a fewer or greater number of panels. FIGS. 16*a* and 16*b* illustrate an embodiment that includes only two fabric panels 182, 184. As illustrated in FIG. 16*a*, the right bodice 18, left bodice 20, right back upper torso panel 42, left back upper torso panel 44, and skirt portion 14 are all cut from one fabric panel 182 and as illustrated in FIG. 16*b* a back overlap panel 184 is cut from a second fabric panel 186. Back overlap panel 184 is joined with the first fabric panel 182 along back slit 63 to cover back slit 63 when the patient is not being examined.

As mentioned above, although hook and loop fastener material is used in the embodiments illustrated and described herein, other types of fasteners are contemplated for use in the present patient gown. It is preferred that the fasteners used in the present are adjustable to accommodate different sized patients and must not inhibit the comfort of the patient. Examples include but are not limited to ties, materials such as spandex or elastic, or adjustable sliding seams. Although not preferred, in some embodiments buttons, zippers, and even snaps may be utilized.

In other embodiments, a self-adhering, re-configurable wire-type frame may be incorporated within portions of the patient gown along various seams to hold portions of the gown in open or closed positions. For example, the right and left bodices may include a self-adhering re-configurable frame around the panel perimeter that will hold the panels in an open or partially-open position depending on the situation. Such a frame could also be used along the waistline of the skirt portion.

In still another embodiment, magnetic coupling devices (such as magnetic tabs or strips) could be used in various portions of the patient gown in place of hook and loop fasteners. The magnetic coupling devices could be used to maintain the positioning of either the bodices, the skirt waistline, or the lower back closure.

Regarding the blouse portion and bodices in particular, it is possible to have an embodiment where the bodices do not include fasteners. In such an embodiment, the bodices may overlap and be held in place by the weight of the panels themselves. Similarly, the weight and length of the bodices may allow them to be held in an open position by folding them back and over the shoulders of the patient.

In still another embodiment, the blouse portion and skirt portion may not be connected. In such an embodiment, the patient could wear either portion alone or in combination with the other portion. Depending on the type of examination required, the patient may only be required to wear one of the portions thereby allowing the patient to remain at least partially clothed in their own garments.

In another embodiment, additional fasteners may be added to both the front of the blouse portion and the front of the skirt portion to removably attach to the front of the blouse portion with the adjacent front of the skirt portion.

In addition to the needs identified above, there is also a need for a patient and doctor-centered gown that both enables greater privacy for the patient and easier and more selective examination by the doctor or medical professional. Such a need has become even more evident considering the shortage and demand for patient gowns due (at least in no small part) by the unprecedented number of individuals affected by the COVID-19 pandemic, particularly the alarming rates of occupancy in hospitals and other health facilities. Existing gowns either falter because they lack the durability to adequately clothe the patient during an examination (in such a case, typically wearing multiple gowns is required), or because existing gowns lack the flexibility to selectively examine the patient without exposing areas the patient does not want exposed. As evident from the disclosure as a whole, the embodiments described herein provide a solution that benefits both professionals and patients alike.

Figure 17A:
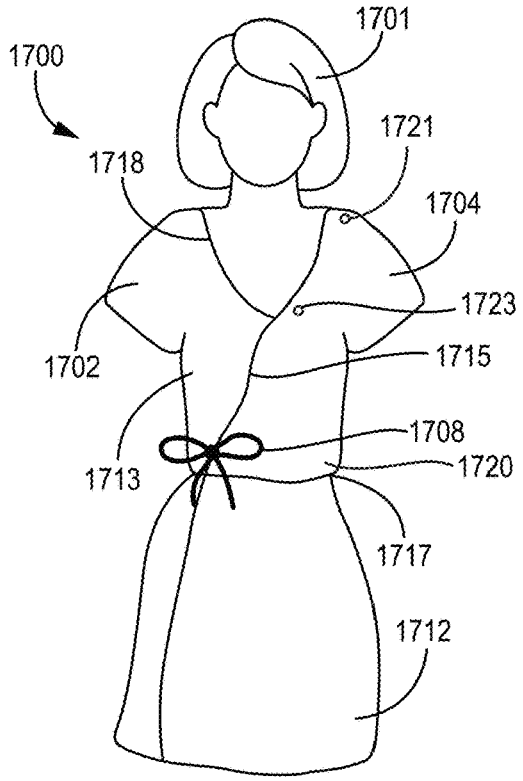
FIGS. 17*a*, 17*b*, and 17*c* illustrate a front view, a back view and a partially open front view, respectively, of one embodiment of the present patient gown as worn by a patient.
Figure 17B:
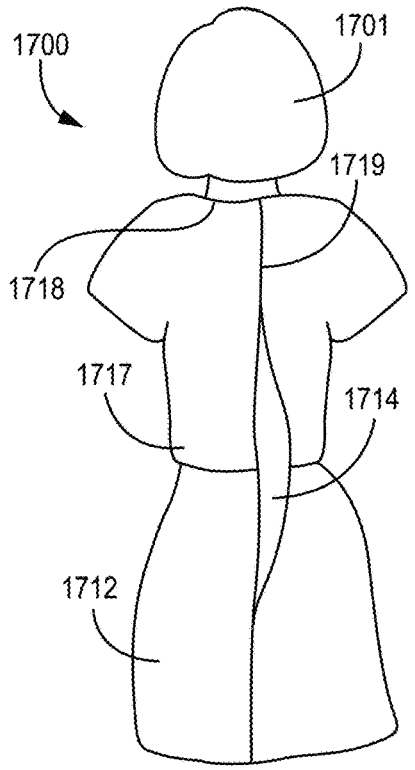
Figure 17C:
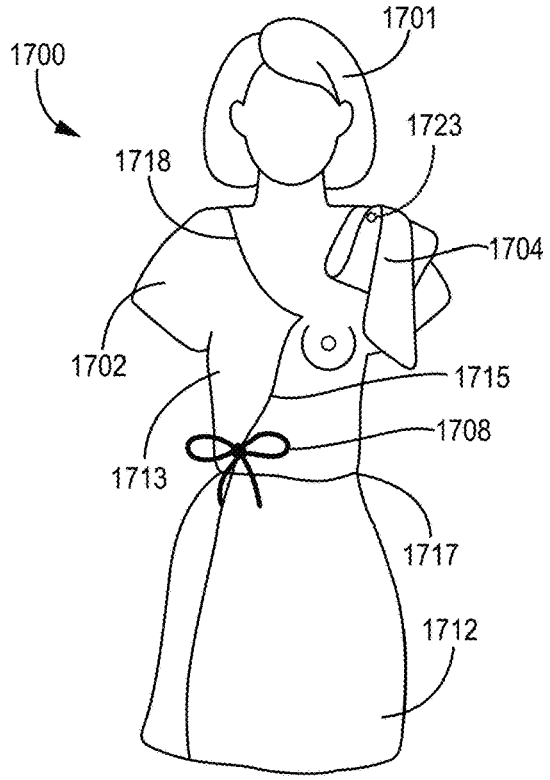
Figure 18A:
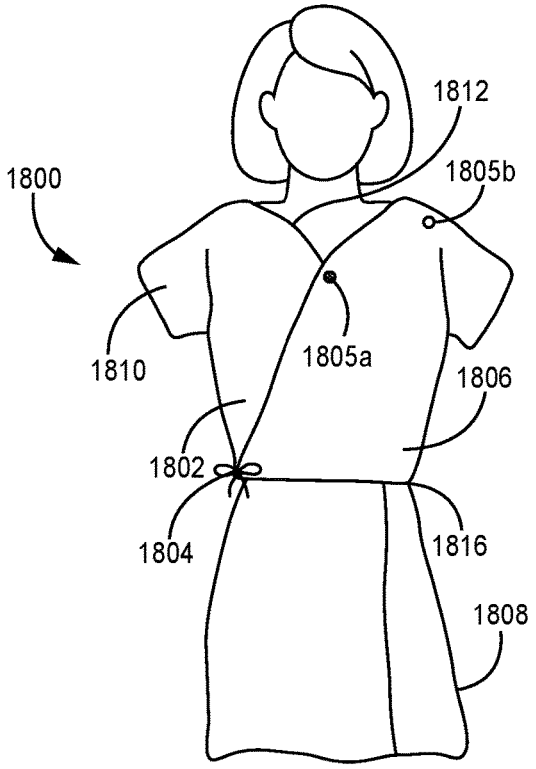
FIGS. 18*a* and 18*b* illustrate a front and back view, respectively, of one embodiment of the present patient gown as worn by a patient.
Figure 18B:
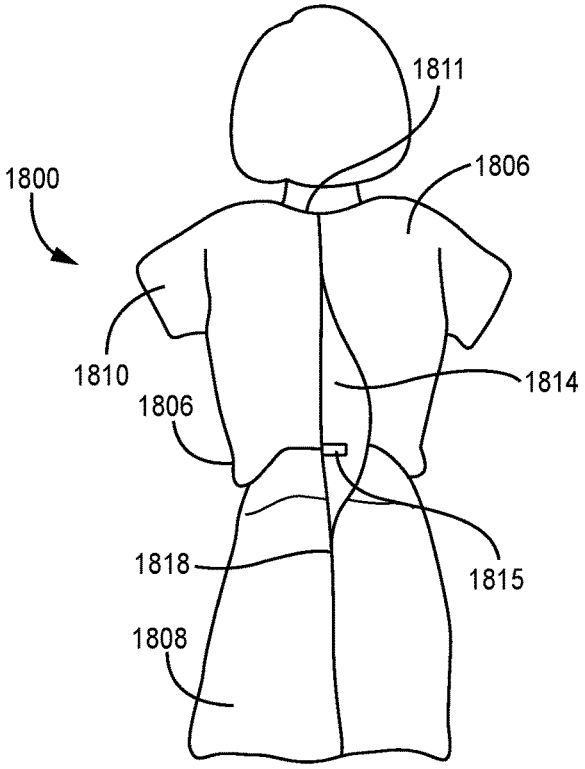
Figure 19:
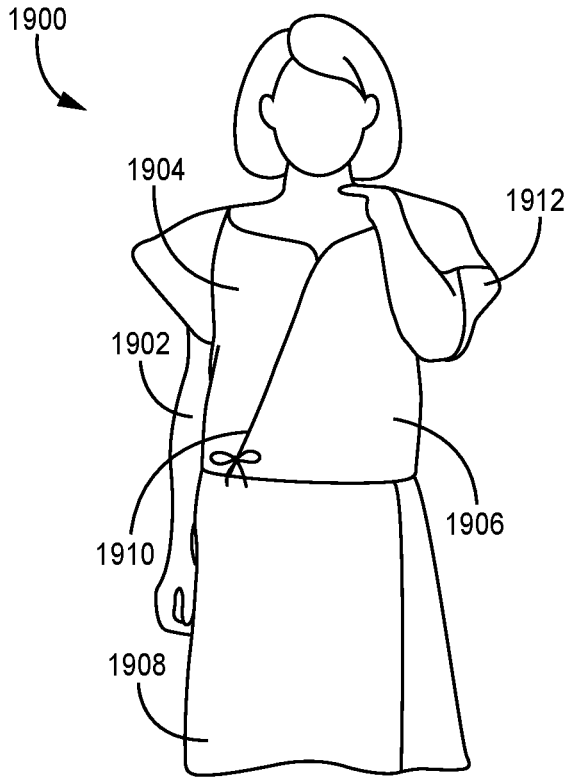
FIG. 19 illustrates a front view of one embodiment of the present patient gown as worn by a patient.
Figure 20:
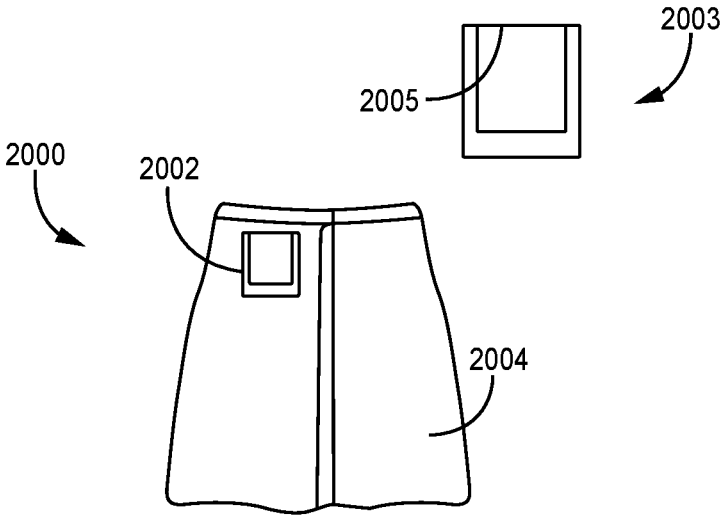
FIG. 20 illustrates a lower portion of one embodiment of the present patient gown including a pocket that can be used to store personal items.

FIGS. 17*a*- 22 illustrate additional examples of a patient gown (in one example, a Malama Dutch Gown) that is worn by a user while undergoing medical treatment at a hospital or other medical/health facility (e.g., paramedical facility, alternative/holistic health facility, etc.). FIGS. 17*a* and 17*b* illustrate a front and back view, respectively, of one example of the patient gown. FIGS. 18*a* and 18*b* illustrate a front and back view, respectively, of an alternative example of the patient gown. FIG. 19 illustrates an example of the patient gown as it is worn by a patient. FIG. 20 illustrates an example of a pocket that can be placed on a lower portion of the patient gown. FIGS. 21*a*-21*c* illustrate additional examples and details of the coupling between the upper and lower portions of a patient gown. FIG. 22 illustrates an additional example of a patient gown.

Referring to FIGS. 17*a* and 17*b*, when worn by a patient 1701, in some examples the gown body (comprising a first upper portion 1702, second upper portion 1704, and lower portion 1712) can be worn by the patient 1701 when in a hospital setting and/or when being examined by a medical professional. Specifically referring to FIG. 17*a*, patient gown 1700 includes a first upper portion 1702, second upper portion 1704, and lower portion 1712. The first upper portion 1702 and second upper portion 1704 can be coupled together in the front of the patient gown 1700 through a fastening region 1715 that in some examples extends from the collar 1718 to the lower portion 1712. Fastening region 1715 can include one or more fastening devices. The front of collar 1718 is in some examples configured to be 1-2 inches below the collarbone of patient 1701.

In some examples, one or more ties 1708 are included along the fastening region 1715 and can be used to tie the first upper portion 1702, second upper portion 1704, and/or lower portion 1712 together when not being examined. In addition to (or instead of) using one or more ties 1708, the fastening region 1715 can include other fasteners 1723 such as adhesive material (e.g., Velcro etc.) and/or one or more coupling devices (e.g. snaps, etc.) along the length of the fastening region to couple the first upper portion 1702, second upper portion 1704, and/or lower portion 1712 together when not being examined by a medical professional. As an example, fastening region 1715 can include one or more coupling devices (such as snaps) in at least 3 locations: one positioned near the neckline (or collar) of the patient, one positioned right below the breastline of the patient, and one positioned near the intersection with horizontal seam 1717 approximately at the waistline. In some embodiments, the ties or other fasteners are positioned equidistant along fastening region 1715. The adhesive material and/or fasteners can be configured to be easily separable for patients who have difficulties or pain with hand movements (e.g., arthritic patients). When undergoing examination, the fastening region 1715 can be opened to expose the frontal region of the patient 1701. By including the one or more ties 1708 or other fasteners 1723 such as adhesive material, and/or coupling device(s), the patient 1701 may undergo examination of the frontal region without having to remove or fully de-couple the first upper portion 1702 and second upper portion 1704.

In some examples, patient gown 1700 includes one or more ties, adhesive material, and/or coupling devices (hereinafter first coupler 1721) located on the exterior surface 1720 of the shoulder or shoulder region of first upper portion 1702 and/or second upper portion 1704 (shown in FIG. 17A). When fastening region 1715 is opened, the ties 1708 or other fasteners 1723, can then couple with first coupler 1721 at the shoulder region. For example, if a medical professional needs to examine the left chest area of patient 1701 (e.g., a breast examination), second upper portion 1704 can be moved upwards to expose the chest area see FIG. 17C. To secure second upper portion 1704 so that it does not interfere with or otherwise hinder the examination of the exposed area, one or more of ties 1708 or other fasteners 1723 can connect to the first coupler 1721 located on the shoulder region and secure second upper portion 1704. This also enables first upper portion 1702 to remain closed while the medical professional examines the exposed areas of second upper portion 1702. When examination of the exposed area has finished, the connection can be de-coupled. First upper portion 1702 can function in a similar fashion. Configuring the shoulder region of first upper portion 1702 and/or second upper portion 1704 to have the first coupler 1720 compatible with ties 1708 and/or other fasteners 1723 enables easier and more selective examination while the of the body not being examined can remain covered.

The one or more ties 1708 can be configured to serve a temporary storage purpose. For example, tie 1708 can be made of a suitable material that enables it to hold jewelry (e.g., earrings, body piercings, etc.) worn by patient 1701. Patient 1701 can remove the jewelry and attach it to tie 1708 (for example, by tying the jewelry or piercing the fabric of tie 1708) during examination. In doing so, the patient can easily remove the jewelry from tie 1708 once examination is complete instead of storing it someplace where it might be forgotten by the patient. This further enables jewelry to stay closely proximate to the patient's body while still enabling the patient to undergo many examination procedures (e.g., imaging procedures) that otherwise would not be operable because of jewelry affixed to the patient (such as a body piercing located at or near the anatomy being imaged).

The second upper portion 1704 is configured to engage with the first upper portion 1702 at or approximately near the waistline. of patient 1701. For example, the first upper portion 1702 and second upper portion 1704 can be joined by a horizontal seam 1717. In some embodiments, the horizontal seam 1717 can be located at or approximately near the waistline. In some examples, at least a portion of horizontal seam 1717 can separate from lower portion 1712 (for example, at the right or left side of patient gown 1700); this separation may continue to the front part of patient gown 1700 as well.

As shown in FIG. 17*a*, in some examples, a portion of the second upper portion 1704 crosses over the first upper portion 1702 or vice-versa, in an approximately diagonal manner at fastening region 1715 from collar 1718 to horizontal seam 1717. For example, starting from the bottom of collar 1718, second upper portion 1704 crosses over the first upper portion 1702 instead of intersecting with first upper portion 1702 straight downwards to horizontal seam 1717. In some examples, the curvature of fastening region 1715 can be designed to couple first upper portion 1702 and second upper portion 1704 in between the breasts of patient 1701 and to couple the two portions diagonally in the lower chest region (e.g., upper abdomen or thorax/torso regions) of patient 1701 to horizontal seam 1717. Configuring fastening region 1715 in this fashion helps to increase coverage of the breast area during examination so that a patient (particularly a woman patient) can feel more comfortable during periods of invasive examination.

Referring to FIG. 17*b*, the upper portion of the gown body includes a vertical fastening region 1719 that may extend from collar 1718 to the bottom of lower portion 1712 (but in some examples only extends to a portion of the upper portion and lower portion 1712). Vertical fastening region 1719 can be opened (e.g., at opening 1714) to expose the patient's back and/or rear region during examination. Horizontal seam 1717 can be opened as shown in FIG. 17*b* during examination as well. In some examples, the vertical fastening region 1719 can include adhesive material (e.g., VELCRO etc.) and/or one or more coupling devices (e.g. snaps, etc.) along the length of the fastening region to couple the first upper portion 1702, second upper portion 1704, and/or lower portion 1712 together when not being examined by a medical professional.

FIGS. 18*a* and 18*b* illustrate front and back views, respectively, of an example of a patient gown 1800. In FIG. 18*a*, the front collar 1812 is designed to rest below the collarbone and may be of any shape and covers the chest at least from the axillary line (e.g., the armpit) and below to the end of the waistline. In the example shown in FIG. 18*a*, the sleeve 1810 is a circular (radial) design, which may be better suited for smaller or thinner patients. In FIG. 18*b*, the sleeve 1809 is an elliptical design that may be better suited for larger patients. In other examples, the sleeve of the gown can have a different shape or profile. Sleeve 1809 in some examples can cover the patient's shoulders and can extend in a long-sleeve, short-sleeve, or any other length down to the patient's arm.

Similar to FIG. 17*a*, patient gown 1800 includes a fastening region 1802 that connects the upper portions of patient gown 1800. In the example shown in FIGS. 18*a*-18*b*, the patient gown 1800 includes three ties 1804. However, it should be understood that the patient gown 1800 can include one or more ties 1804 or no ties 1804 if an adhesive material or coupling device is used. Lower portion 1808 can be coupled to upper portion 1806 via a horizontal seam 1816. In some examples, the lower portion 1808 can be separate from the upper portion 1806. Patient gown 1800 further includes a vertical fastening region 1818 that, when opened (e.g., at opening 1814) can expose the back and/or rear regions of the patient during examination. Vertical fastening region 1818 in some examples includes a fastening region 1815 made of an adhesive material or that includes a coupling device that connects the upper portions of patient gown 1800 together, and which can be de-coupled when the patient needs to be examined.

In some examples of patient gowns 1700, 1800, the fastening regions 1715, 1802 can include one or more snaps that connect first upper portion and second upper portion together. In some such examples, the snaps can be approximately 0.75 inches in diameter. In some such examples, a snap can be coupled to the inner lower corner that connects first upper portion (for example, first upper portion 1702) and second upper portion (for example, second upper portion 1704). Furthermore, in some embodiments the vertical fastening regions 1719, 1818 and horizontal seam 1717, 1816 intersect at or approximately near the patient's waistline. Also shown in FIG. 18A, patient gown 1800 and any other of the patient gown embodiments described herein includes one or more coupling devices 1805*a*. The coupling devices 1805*a* can be positioned near the intersection of the bottom of the neckline and the fastening region 1802, although in other examples are located in other parts of the fastening region 1802. Coupling device 1805*a* is configured to couple to a corresponding coupling device 1805*b* located near the top of the shoulder of the gown 1800. When multiple coupling devices 1805*a* are used, each coupling device 1805*a* can couple to a respective coupling device 1805*b*. For example, coupling device 1805*a* can be a male snap that couples to a female snap 1805*b*. Additionally, the coupling device 1805*a* can couple to coupling device 1805*b* while other coupling devices (such as tie 1804) at the fastening region 1802 couple the first upper portion 1702 and second upper portion 1704 together. In doing so, the patient gown 1800 provides selective exposure to frontal regions instead of exposing the totality of the patient's upper body to the medical examiner. Coupling devices 1805*a*, 1805*b* can be placed in other parts of the patient gown 1800 or any of the exemplary patient gowns described herein.

FIG. 19 illustrates an embodiment of a patient gown that is worn by a patient while undergoing medical examination or care, such as by the patient gowns described with respect to FIGS. 17*a*-18*b* above. Patient gown 1900 can be made of a soft cloth or other material that is comfortable for patient 1902 yet is resistant to tearing. Preferred materials are those which in some examples are sufficiently opaque so that the patient's body or body contours are not visible when exposed to highly lit environments. In some embodiments, at least a portion of the first upper portion 1904 and second upper portion 1906 can overlap with the lower portion 1908. Patient gown 1900 is designed so that patient 1900 can be more comfortable and at ease during medical examination (particularly for women). The first upper portion 1904 and second upper portion 1906 is configured to open in the front at fastening region 1910 for easier access to patient 1902 frontal areas without requiring patient 1902 to take off the entire gown. Lower portion 1908 is configured to wrap around the waistline of patient 1902 and closes at a vertical fastening region (not shown in FIG. 19). The back of patient gown 1900 can include one or more hooks or loops (not shown in FIG. 19) configured to close lower portion 1908. In some embodiments, sleeves 1912 can resemble a kimono-style design or other design that reduces or minimizes the number of seams along the sleeve regions of the patient gown.

FIG. 20 illustrates an example lower portion 2000 of a patient gown that includes a pocket 2002 (e.g., a patch pocket) coupled to the patient gown. Pocket 2002 can be used to store personal items of the patient, such as the patient's jewelry, phone, etc., but can also be used to store other items as well. For example, small items that are given to the patient by a medical professional while undergoing examination, such as a cardiac monitor, glucose meter, insulin pump, and the like, can also be stored within pocket 2002. Pocket 2002 can be sewn onto the exterior of the gown or otherwise attached to the patient gown. In some examples, pocket 2002 can be attached to the upper right corner of the lower portion (e.g., the skirt) of the patient gown while worn by the patient. However, pocket 2002 can be attached at other places of the patient gown as well. In another example, pocket 2002 is attached based on whether the patient is right-hand or left-hand dominant (e.g., the patient feels more comfortable picking up items with either their right or left hand). If the patient is right-hand dominant, then pocket 2002 can be attached as shown in FIG. 20, that is, attached to the upper right corner of lower portion 2000, or anywhere else on the right side of lower portion 2000. In contrast, for left-hand dominant patients, pocket 2002 can be attached on the upper left corner of lower portion 2000, or anywhere else on the left side of lower portion 2000. In a particular example, pocket 2002 can be attached at or near the waistline of the patient. In some examples, pocket 2002 is attached on the upper portion(s) of the patient gown (such as the upper portions of the patient gowns shown in FIGS. 17-19), or multiple pockets 2002 can be attached in both the upper and lower portions of the patient gown. Pocket 2002 may also have additional ports or holes to insert leads connected from medical equipment to smaller devices stored in the pocket (not shown in FIG. 20).

FIG. 20 further shows a magnified view of an example pocket 2003 that can be affixed to a patient gown. In some examples, pocket 2003 has a rectangular shape. The dimensions of the pocket 2003 can vary depending on desired size. In one example, the pocket 2003 has approximate dimensions of 4 inch width by 6 inch length. However, pocket 2003 can be other shapes and sizes as well. Pocket 2003 in some examples includes 3 edges sewn onto lower portion 2004, in which the top edge 2005 is the open edge where the patient can store items within.

Figure 21A:
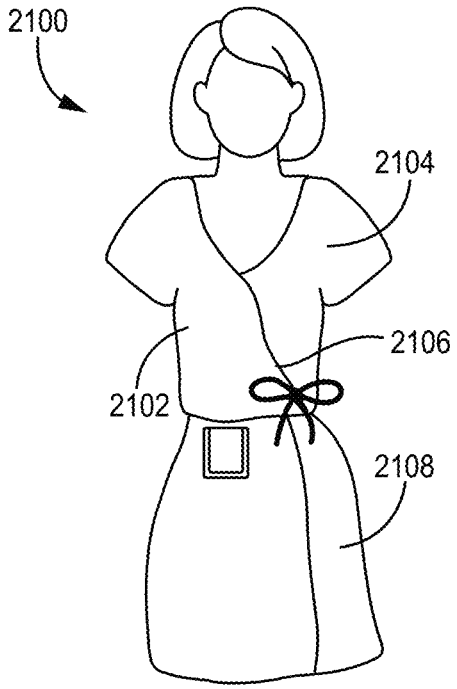
FIG. 21*a* illustrates a back view of one embodiment of the present patient gown including a pocket attached to the front side of the lower portion.
Figure 21B:
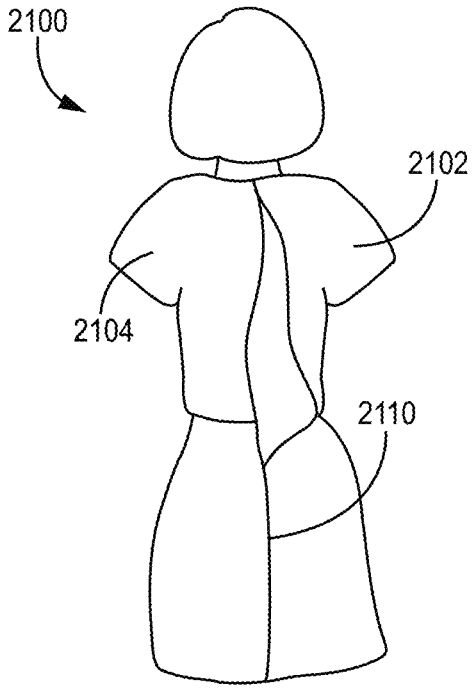
FIG. 21*b* illustrates a back view of one embodiment of the present patient gown including a vertical fastening region in an open position.
Figure 21C:
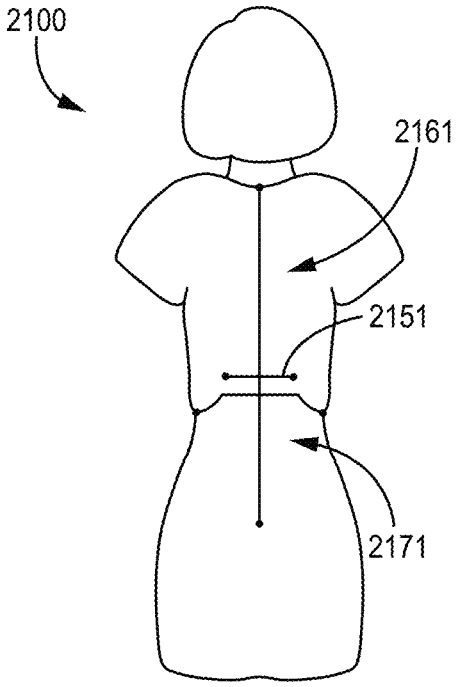
FIG. 21*c* illustrates a back view of one embodiment of the present patient gown including a vertical fastening region in a closed position.

Referring to FIGS. 21*a*-21*c*, FIG. 21*a* illustrates a front view of an example of a patient gown. FIG. 21*b* illustrates a rear view of an example of a patient gown, such as the rear of the patient gown illustrated in FIG. 21*a*. FIG. 21*c* illustrates a rear view of an example of a patient gown with a seam closure between the upper portions and lower portion of the patient gown. FIGS. 21*a*-21*c* can include similar features to those described above with respect to FIGS. 17*a*-20.

As shown in FIG. 21*a*, first upper portion 2102 crosses over second upper portion 2104 in a diagonal direction at horizontal seam 2106 in the opposite direction than as shown in FIG. 17*a*. In some examples, the width of the upper portion of patient gown 2100 can shrink slightly as the bottom of the upper portion couples with the lower portion.

Similar to FIG. 17*b*, vertical fastening region 2110 can be opened both from the upper portion (first upper portion 2102 and second upper portion 2104) and lower portion 2108 of the patient gown 2100 when needed to examination the rear and back regions of the patient, as shown in FIG. 21*b*.

When vertical fastening region 2110 (comprising second fastening region 2161 and third fastening region 2171) is closed, as shown in FIG. 21*c*, a seam closure 2151 can close the upper and lower portions of the patient gown when the rear and back regions are not being examined. The second fastening region 2161 includes at least one fastening device 2175 and the third fastening region 2171 includes at least one fastening device 2177. Each fastening device 2175, 2177 is shown as a tie for pedagogical illustration understanding that other devices can be used to open and close the second fastening region 2161 and third fastening region 2171.

Figure 22A:
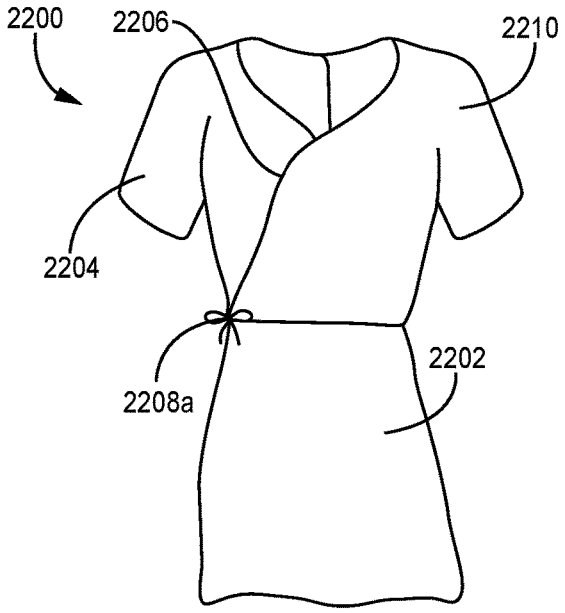
FIGS. 22*a* and 22*b* illustrates a front and side view, respectively, of one embodiment of the present patient gown.
Figure 22B:
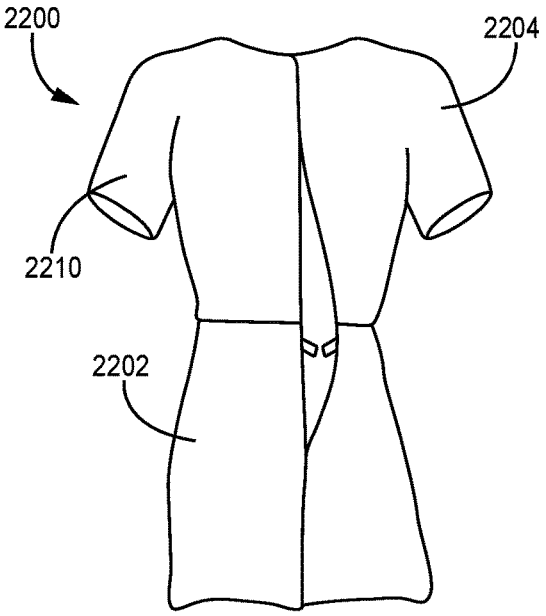

FIGS. 22*a*-22*b* illustrate an example of a patient gown 2200 in which the bottom of first upper portion 2204 and second upper portion 2210 has a slightly wider frame than the top of the lower portion 2202. It should be noted that although fastening region 2206 depicts three ties 2208*a*-*c*, in some examples, only one tie is used (e.g., tie 2208*a*), or other adhesive material or coupling devices are used. FIGS. 22*a*-22*b* can include similar features to those described above with respect to FIGS. 17*a*-21*c*.

The patient gowns described in the present application can be worn by men and women. Furthermore, the patient gowns described herein can be worn in any setting suitable for medical examination, including hospitals, senior living facilities, health care clinics, physical therapy clinics, or any other type of medical examination setting.

Features described in one or more examples with respect to the Figures can in general be implemented in other examples as well. That is, the features illustrated or described in connection with one exemplary embodiment may be combined with the features of other examples. Thus, any of the various examples described herein can be combined to provide further examples.

The terms "about", "approximately", or "substantially" mean that the value or parameter specified may be somewhat altered, as long as the alteration does not result in nonconformance of the process or structure to the illustrated embodiment from the perspective of one having ordinary skill in the art. For instance, unless otherwise indicated, a numerical quantity modified by the term "substantially" can be altered to within ±20% of the specified value. Finally, the term "exemplary" merely indicates the accompanying description is used as an example, rather than implying an ideal, essential, or preferable feature of the invention.

EXAMPLE EMBODIMENTS

Example 1 includes a patient gown, comprising: a first portion configured to cover at least a portion of an upper torso of a patient, the first portion comprising: a body with two sleeves extending therefrom, wherein the body includes a front and a back; wherein the front of the first portion includes a first fastening region extending from the top to the bottom of the front of the first portion, wherein a right side of the front of the first portion comprises one side of the first fastening region, wherein a left side of the front of the first portion comprises another side of the first fastening region, wherein the first fastening region includes at least one first fastening device configured to connect the right side of the front of the first portion with the left side of the front of the first portion, wherein the at least one first fastening device is configured to at least partially close the first fastening region, wherein the back of the first portion includes a second fastening region extending from a top of the first portion to a bottom of the first portion, wherein a right side of the back of the first portion comprises one side of the second fastening region, wherein a left side of the back of the first portion comprises another side of the second fastening region, wherein the second fastening region includes at least one second fastening device configured to connect the right side of the back of the first portion with the left side of the back of the first portion, wherein the at least one second fastening device is configured to at least partially close the second fastening region; and a second portion configured to cover at least a portion of a lower body of the patient, the lower portion comprising: a front and a back; wherein a top of the second portion is configured to engage with the bottom of the first portion to form a waistline, wherein the back of the second portion includes a third fastening region in alignment with the second fastening region of the back of the first portion, wherein a right side of the back of the second portion comprises one side of the third fastening region, wherein a left side of the back of the second portion comprises another side of the third fastening region, wherein the third fastening region includes at least one third fastening device configured to couple the right side of the back of the second portion with the left side of the back of the second portion, wherein the at least one third fastening device is configured to at least partially close the third fastening region.

Example 2 includes the patient gown of Example 1, wherein the first fastening region extends approximately diagonally from a collar of the top of the first portion towards the bottom of the first portion.

Example 3 includes the patient gown of any of Examples 1-2, wherein a bottom portion of the first portion includes at least one coupling device configured to couple a bottom portion of the right side of the front to a respective coupling device on a top portion of the right side of the front, wherein the bottom portion includes at least one coupling device configured to couple a bottom portion of the left side of the front to a respective coupling device on a top portion of the left side of the front.

Example 4 includes the patient gown of any of Examples 1-3, wherein the at least one first fastening device comprises a tie, a hook and loop fastener, a snap, a magnet, a button, a zipper, and/or an adhesive material.

Example 5 includes the patient gown of any of Examples 1-4, wherein the first fastening region includes: a first tie positioned approximately at a collar of the top of the first portion; a second tie positioned approximately at the waistline; and a third tie positioned between the first tie and the second tie.

Example 6 includes the patient gown of any of Examples 1-5, wherein the front of the second portion and/or the back of the second portion includes at least one pocket.

Example 7 includes the patient gown of Example 6, wherein the at least one pocket is located near the top of the lower portion, wherein the at least one pocket includes at least one open edge.

Example 8 includes the patient gown of any of Examples 6-7, wherein the at least one pocket includes at least one port configured to pass connections from medical equipment therethrough to at least one medical device stored in the at least pocket.

Example 9 includes the patient gown of any of Examples 1-8, wherein the bottom of the first portion further comprises a seam closure, wherein the seam closure is configured to open and close the waistline.

Example 10 includes a patient blouse for covering an upper torso of a patient, comprising: a body with two sleeves extending therefrom, wherein the body includes a front portion and a back portion, wherein the front portion includes a first fastening region extending from a top of the front portion to a bottom of the front portion, wherein a right side of the front portion comprises one side of the first fastening region, wherein a left side of the front portion comprises another side of the first fastening region, wherein the first fastening region includes at least one first fastening device configured to connect the right side of the front portion with the left side of the front portion, wherein the at least one first fastening device is configured to at least partially close the first fastening region, wherein the back portion includes a second fastening region extending from a top of the back portion to a bottom of the back portion, wherein a right side of the back portion comprises one side of the second fastening region, wherein a left side of the back portion comprises another side of the fastening region, wherein the second fastening region includes at least one second fastening device configured to connect the right side of the back portion with the left side of the back portion, wherein the at least one second fastening device is configured to at least partially close the second fastening region.

Example 11 includes the patient blouse of Example 10, wherein the first fastening region extends approximately diagonally from a collar of the front portion towards the bottom of the front portion.

Example 12 includes the patient blouse of any of Examples 10-11, wherein the first fastening region extends diagonally towards the right side of the bottom of the front portion or the left side of the bottom of the front portion of the body.

Example 13 includes the patient blouse of any of Examples 10-12, wherein the first fastening region is positioned along a neckline of the patient blouse, wherein the at least one fastening device is configured to fasten the neckline to the first fastening region.

Example 14 includes the patient blouse of any of Examples 10-13, wherein the at least one first fastening device comprises a tie, a hook and loop fastener, a snap, a magnet, a button, a zipper, and/or an adhesive material.

Example 15 includes the patient blouse of any of Examples 10-14, wherein the front portion includes at least one coupling device configured to couple the right side of the front portion to a respective coupling device on a top portion of the right side, wherein the front portion includes at least one coupling device configured to couple the left side of the front portion to a respective coupling device on a top portion of the left side.

16 includes the patient blouse of Example 15, wherein the right side of the front portion is configured to couple to the respective coupling device on the top portion of the right side while the left side is in a closed position, and wherein the left side of the front portion is configured to couple to the respective coupling device on the top portion of the left side while the right side is in a closed position.

Example 17 includes a patient skirt for covering a lower body of a patient, comprising: a front portion, a back portion, and an interior portion; wherein the back portion includes a vertical fastening region extending from a top of the back portion to a bottom of the back portion, wherein a right side of the back portion comprises one side of the vertical fastening region, wherein a left side of the back portion comprises another side of the vertical fastening region, wherein the vertical fastening region includes at least one fastening device configured to couple the right side of the back portion with the left side of the back portion, wherein the at least one fastening device is configured to at least partially open and close the vertical fastening region, wherein a top of the interior portion includes a first horizontal fastening region positioned along a waistline of the patient skirt, wherein a top of the front portion and/or a top of the back portion includes a second horizontal fastening region corresponding to the first horizontal fastening region, wherein the second horizontal fastening region is configured to engage with the first horizontal fastening region.

Example 18 includes the patient skirt of Example 17, wherein the front portion and/or the back portion includes at least one pocket.

Example 19 includes the patient skirt of Example 18, wherein the at least one pocket is located near the top of the patient skirt portion, wherein the at least one pocket includes at least one open edge.

Example 20 includes the patient skirt of any of Examples 18-19, wherein the at least one pocket includes at least one port configured to pass connections from medical equipment therethrough to at least one medical device stored in the at least pocket.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. A patient gown, comprising:

a first portion configured to cover at least a portion of an upper torso of a patient, the first portion comprising:

a body with two sleeves extending therefrom, wherein the body includes a front and a back;

wherein the front of the first portion includes a first fastening region extending from a top to a bottom of the front of the first portion, wherein a right side of the front of the first portion comprises one side of the first fastening region, wherein a left side of the front of the first portion comprises another side of the first fastening region, wherein the first fastening region comprises a first fastener and a second fastener configured to connect the right side of the front of the first portion with the left side of the front of the first portion, wherein the first fastener and the second fastener are configured to at least partially close the first fastening region, wherein the back of the first portion includes a second fastening region extending from a top of the back of the first portion to a bottom of the back of the first portion, wherein a right side of the back of the first portion comprises one side of the second fastening region, wherein a left side of the back of the first portion comprises another side of the second fastening region, wherein the second fastening region includes at least one third fastener configured to connect the right side of the back of the first portion with the left side of the back of the first portion, wherein the at least one third fastener is configured to at least partially close the second fastening region; and a second portion configured to cover at least a portion of a lower body of the patient, the second portion comprising:

a front and a back;

wherein a top of the second portion is configured to engage with the bottom of the first portion to form a waistline, wherein the back of the second portion includes a third fastening region in alignment with the second fastening region of the back of the first portion, wherein a right side of the back of the second portion comprises one side of the third fastening region, wherein a left side of the back of the second portion comprises another side of the third fastening region, wherein the third fastening region includes at least one third fastener configured to couple the right side of the back of the second portion with the left side of the back of the second portion, wherein the at least one third fastener is configured to at least partially close the third fastening region, wherein the first fastening region extends approximately diagonally from a collar of the top of the front of the first portion directly towards the bottom of the front of the first portion such that the first fastening region ends at either an end of the left side of the front of the first portion or an end of the right side of the front of the first portion, wherein the front of the first portion includes at least one first coupler on an exterior surface of a shoulder of the patient gown, wherein the at least one first coupler is configured to selectively mate with the a portion of the first fastener of the first fastening region and a portion of the second fastener of the first fastening region while one of the right side or the left side of the front of the first portion remains closed.

2. The patient gown of claim 1, wherein the first fastener is on a bottom portion of the first fastening region.

3. The patient gown of claim 1, wherein the first fastener comprises a tie, a hook and loop fastener, a snap, a magnet, a button, a zipper, and/or an adhesive material.

4. The patient gown of claim 1, wherein the first fastener includes: a first tie positioned approximately at a collar of the top of the front of the first portion; and the second fastener includes a second tie positioned approximately at the waistline; and wherein the first fastening region comprises a third tie positioned between the first tie and the second tie.

5. The patient gown of claim 1, wherein the front of the second portion and/or the back of the second portion includes at least one pocket.

6. The patient gown of claim 5, wherein the at least one pocket is located near the top of the second portion, wherein the at least one pocket includes at least one open edge.

7. The patient gown of claim 5, wherein the at least one pocket includes at least one port configured to pass connections from medical equipment therethrough to at least one medical device stored in the at least one pocket.

8. The patient gown of claim 1, wherein the bottom of the back of the first portion further comprises a seam closure, wherein the seam closure is configured to open and close the waistline.

* * * * *